US008188268B2

(12) United States Patent
Ohashi et al.

(10) Patent No.: US 8,188,268 B2
(45) Date of Patent: May 29, 2012

(54) POROUS CRYSTALLINE SACCHARIDE, ITS PREPARATION AND USES

(75) Inventors: Tetsuya Ohashi, Okayama (JP); Hajime Aga, Okayama (JP); Tetsuya Nakada, Okayama (JP); Toshio Miyake, Okayama (JP)

(73) Assignee: Kabushiki Kaisha Hayashibara Seibutsu Kagaku Kenkyujo, Okayama (JP)

( * ) Notice: Subject to any disclaimer, the term of this patent is extended or adjusted under 35 U.S.C. 154(b) by 703 days.

(21) Appl. No.: 12/159,166

(22) PCT Filed: Dec. 25, 2006

(86) PCT No.: PCT/JP2006/325753

§ 371 (c)(1),
(2), (4) Date: Jun. 25, 2008

(87) PCT Pub. No.: WO2007/074763

PCT Pub. Date: Jul. 5, 2007

(65) Prior Publication Data

US 2010/0222569 A1 Sep. 2, 2010

(30) Foreign Application Priority Data

Dec. 26, 2005 (JP) ..... 2005-372848
Jul. 6, 2006 (JP) ..... 2006-186255

(51) Int. Cl.
*C13K 7/00* (2006.01)

(52) U.S. Cl. ..... 536/123.13

(58) Field of Classification Search ..... None
See application file for complete search history.

(56) References Cited

U.S. PATENT DOCUMENTS

| | | | |
|---|---|---|---|
| 4,282,967 | A | 8/1981 | Boling et al. |
| 4,382,967 | A | 5/1983 | Koshida |
| 4,816,445 | A | 3/1989 | Mitsuhashi et al. |
| 4,996,196 | A | 2/1991 | Mitsuhashi et al. |

FOREIGN PATENT DOCUMENTS

| | | | |
|---|---|---|---|
| JP | 57-54600 | A | 4/1982 |
| JP | 57054600 | A | 4/1982 |
| JP | 61-146199 | A | 7/1986 |
| JP | 61146199 | A | 7/1986 |
| JP | 5-43360 | A | 7/1993 |
| JP | 5-59697 | B2 | 8/1993 |
| JP | 7-10341 | B2 | 2/1995 |
| JP | 3168550 | B2 | 3/2001 |

OTHER PUBLICATIONS

Zeller, B.L. et al., Trends in Food Science & Technology, "Trends in development of porous carbohydrate food ingredients for use in flavor encapsulation", (1999), vol. 9, pp. 389-394.*
Garnier, S. et al., Journal of Thermal Analysis and Calorimetry, "Dehydration Mechanism and Crystallisation Behavior of Lactose", vol. 68, (2002), pp. 489-502.*
Hodge et al., "Useful Properties of Maltose", Cereal Science Today, vol. 17, No. 7, pp. 180-188, (1972).

* cited by examiner

*Primary Examiner* — Shaojia Anna Jiang
*Assistant Examiner* — Bahar Schmidtmann
(74) *Attorney, Agent, or Firm* — Browdy and Neimark, PLLC

(57) ABSTRACT

An object of the present invention is to provide a crystalline saccharide having novel physical properties, a preparation and uses thereof. The present invention solves the above objects by providing a porous crystalline saccharide having a number of pores, a process for producing the same, comprising the step of keeping hydrous crystalline saccharide at an ambient temperature or higher in an organic solvent for the dehydration, and the use thereof.

3 Claims, 15 Drawing Sheets

POROUS CRYSTALLINE SACCHARIDE, ITS PREPARATION AND USES

TECHNICAL FIELD

The present invention relates to a porous crystalline saccharide, particularly, to a porous crystalline saccharide having a number of pores, its preparation and uses.

BACKGROUND ART

It has been well-known that hydrous form and anhydrous form are usually present as forms of crystalline saccharide, and the hydrous crystal can be converted into the anhydrous crystal and vice versa. Trehalose and maltose can be advantageously used in an industrial scale by using those characteristics of converting the forms between hydrous and anhydrous crystal.

Trehalose (α-D-glucosyl α-D-glucoside) is a non-reducing disaccharide where two glucose molecules are bound via α,α-1,1 linkage, and usually obtained as di-hydrate (hereinafter, simply called as "hydrous crystalline trehalose"). While, anhydrous crystalline trehalose can be obtained from the concentrated solution with a moisture content of lower than 10% (w/w). Also, hydrous crystalline trehalose can be converted into anhydrous crystalline trehalose by drying in vacuo at a relatively high temperature. Hydrous crystalline trehalose is stable and hardly adsorbs moisture at the relative humidity of 90% or lower. Anhydrous crystalline trehalose easily absorbs moisture and is converted into stable hydrous crystalline trehalose. By using the characteristic, anhydrous crystalline trehalose can be applied for the powderization of foods containing moisture (Ref. Japanese Patent No. 3,168,550). Hydrous crystalline trehalose is commercialized by Hayashibara Shoji Inc., Okayama, Japan, as "TREHA®". Also, anhydrous crystalline trehalose is commercialized by Hayashibara Biochemical Laboratories Inc., Okayama, Japan, as a reagent.

Maltose has been called as "malt sugar", and is a reducing disaccharide where two glucose molecules are bound via α-1,4 linkage. Since maltose has a reducing end, i.e., an aldehyde group, α- and β-anomers are present in maltose. Maltose is usually obtained as crystalline β-maltose monohydrate (hereinafter, simply called as "hydrous crystalline β-maltose), produced in an industrial scale and commercialized. While, anhydrous crystalline maltose can be obtained from the concentrated solution with a moisture content of less than 5% (w/w) (Ref. Japanese Patent Kokai No. 43,360/93). Since the anhydrous crystalline maltose contains 55 to 80% (w/w) of α-anomer and 20 to 45% (w/w) of β-anomer, the entity is α/β complex crystal. However, since the anhydrous crystalline maltose has a high α-anomer content, it is usually called as "anhydrous crystalline α-maltose" (Ref. Japanese Patent Kokai Nos. 43,360/93 and 10,341/95). The anhydrous crystalline α-maltose is commercialized by Hayashibara Shoji Inc., Okayama, Japan, as "FINETOSE®". Japanese Patent Kokai No. 59,697 and J. E. Hodge et al., "Cereal Science Today", Vol. 17, 7, pp. 180-188 (1972) disclosed anhydrous crystalline β-maltose. However, since the anhydrous crystalline β-maltose has a defect of easily absorbing moisture, it has not been produced in an industrial scale. Since anhydrous crystalline maltose is converted into stable hydrous crystalline β-maltose by absorbing moisture and the resulting hydrous crystalline β-maltose is stable and hardly absorbs moisture at a relative humidity of 90% or lower, anhydrous crystalline α-maltose can be applied for the powderization of foods containing moisture (Ref. Japanese Patent Kokai Nos. 43,360/93 and 10,341/95).

If crystalline saccharide, having different physical properties from those of well-known hydrous or anhydrous crystalline saccharide, can be obtained, it is expected that the field of using crystalline saccharide will be expanded. For example, in the case of sucrose, granulated sugar is known to be produced by shaping sucrose into granule form for improving adhesiveness and solubility and used for frozen dessert such as yoghurt. The granulated sugar has about 10-folds larger specific surface area than crystalline sucrose, but the specific surface area is mere about 0.1 $m^2/g$. Any crystalline saccharide, having more large specific surface area, except for sucrose, is hitherto unknown.

DISCLOSURE OF INVENTION

An object of the present invention is to provide a crystalline saccharide having novel physical properties, preparation and uses thereof.

The present inventors have extensively studied on fine structure of crystalline saccharide. In the course of their studies, it was unexpectedly found that porous crystalline anhydrous saccharide having a number of pores, different from the well-known anhydrous saccharide obtainable by the conventional method, can be produced by keeping hydrous crystalline saccharide in an organic solvent at an ambient temperature or higher for the dehydration. Also, it was found that the resulting porous anhydrous crystalline saccharide has characteristic physical properties such as a large specific surface area, large intrusion volume, and specific pore size distribution. Further, it was found that, in the cases of some saccharides, the resulting porous anhydrous crystalline saccharide can be converted into hydrous crystalline saccharide with keeping a number of pores. Based on the knowledge, the present inventors accomplished the present invention by establishing a porous crystalline saccharide, its preparation and uses.

The present invention solves the above objects by providing a porous crystalline saccharide having a number of pores, a process for producing the porous crystalline saccharide, comprising the step of keeping hydrous crystalline saccharide in an organic solvent at an ambient temperature or higher for the dehydration, and the uses.

Since the porous crystalline saccharide of the present invention has a number of pores and a large specific surface area, it exhibits good solubility and can be advantageously used for various foods and beverages, cosmetics, and pharmaceuticals. In the case of mixing the porous crystalline saccharide and oils, it exhibits good oil-keeping ability in comparison with well-known crystalline saccharides. According to the present invention, the porous crystalline saccharide can be easily produced by the process comprising the step of dehydrating hydrous crystalline saccharide in an organic solvent.

EXPLANATION OF SYMBOLS

Figure 1:
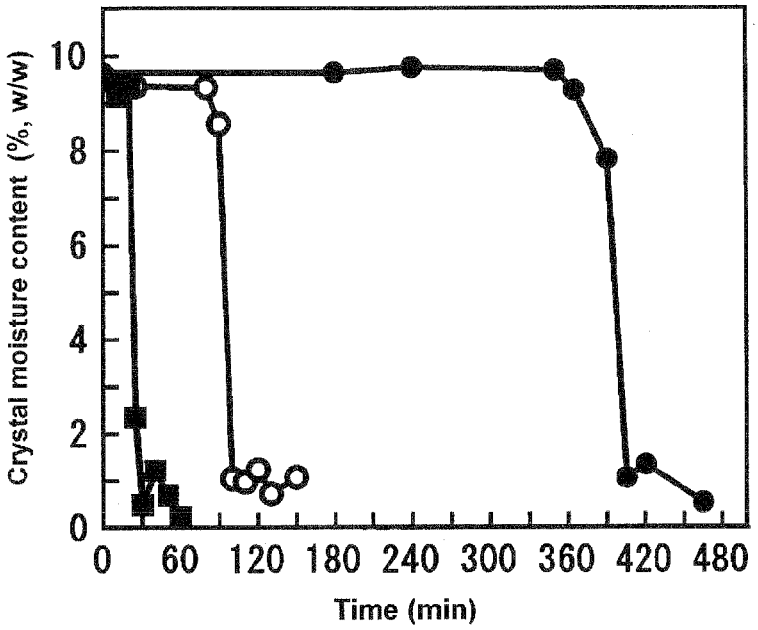
FIG. 1 shows the relationship of the time course of crystal moisture content and the temperature of treatment when hydrous crystalline trehalose was converted into anhydrous crystalline trehalose by dehydrating in ethanol.

In FIG. 1,

●: treated at 50° C., ○: treated at 60° C., ■: treated at 70° C.

Figure 8:
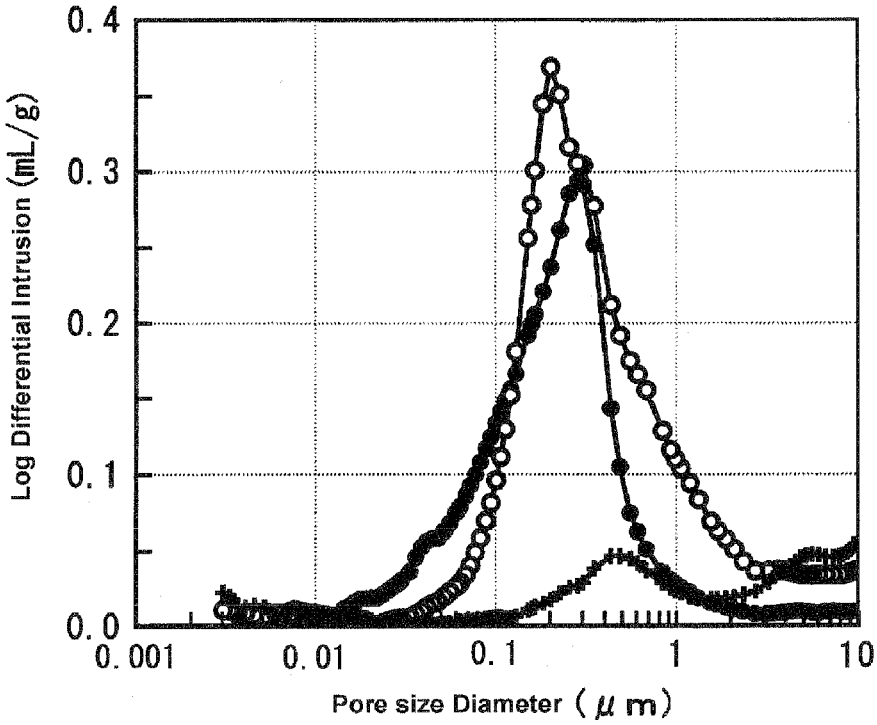
FIG. 8 shows the pore size distribution of the porous anhydrous crystalline trehalose, measured by the mercury filling method.

In FIG. 8,

●: Porous anhydrous crystalline trehalose obtained by treating at 50° C. for 465 min ○: Porous anhydrous crystalline trehalose obtained by treating at 70° C. for 60 min +: Anhydrous crystalline trehalose (Control)

Figure 9:
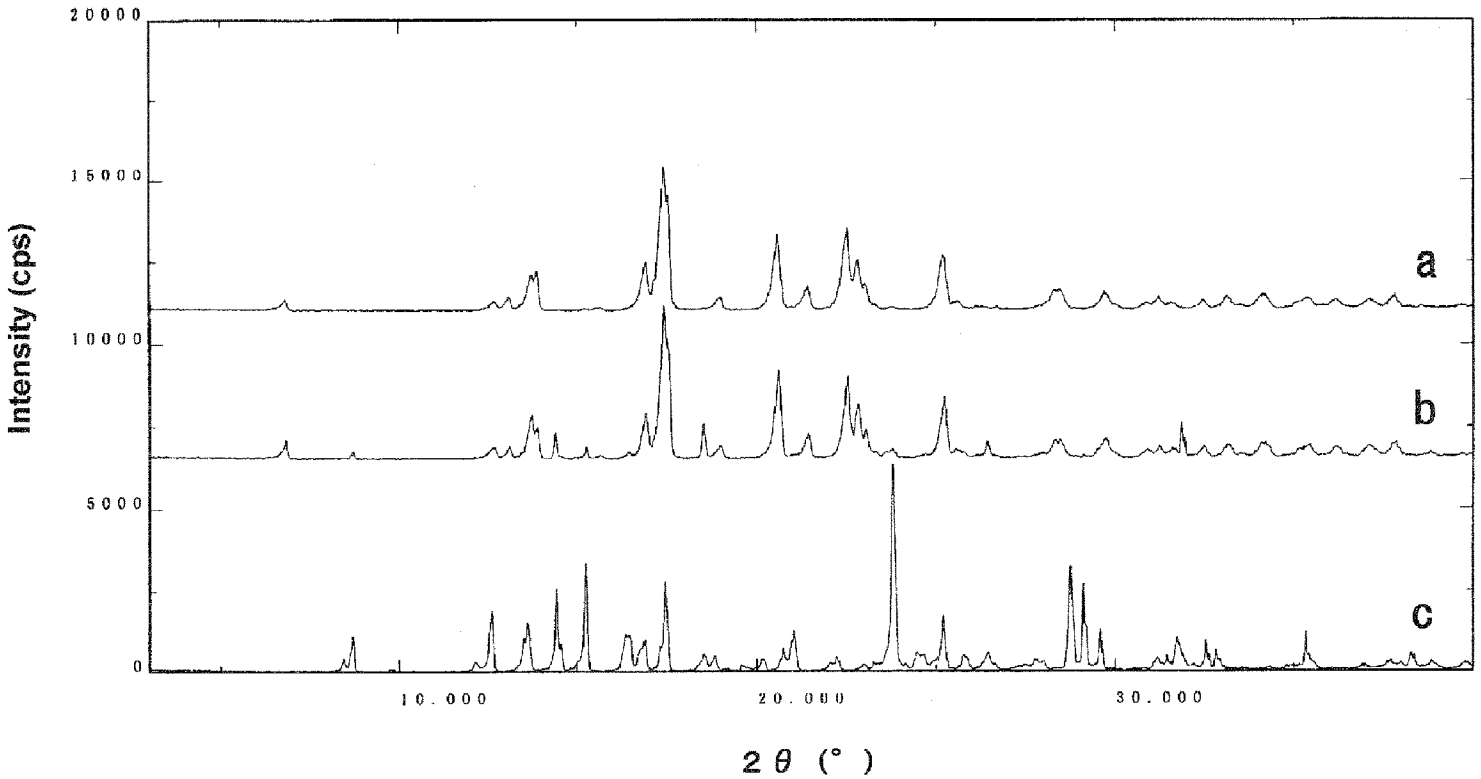
FIG. 9 shows the powdery X-ray diffraction diagram of the porous anhydrous crystalline trehalose and those of anhydrous or hydrous crystalline trehalose of the controls.

In FIG. 9, a: Porous anhydrous crystalline trehalose obtained by treating at 70° C. for 60 min b: Anhydrous crystalline trehalose (Control)

c: Hydrous crystalline trehalose (Control)

Figure 10:
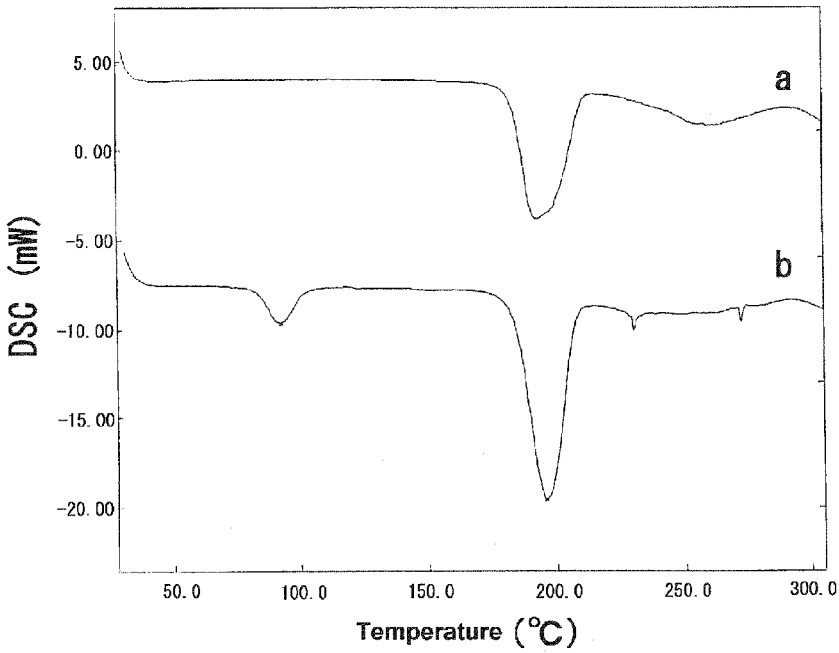
FIG. 10 shows the endothermic pattern on differential scanning calorimetry (DSC) of the porous anhydrous crystalline trehalose and that of the control anhydrous crystalline trehalose.

In FIG. 10, a: Porous anhydrous crystalline trehalose obtained by treating at 70° C. for 60 min b: Anhydrous crystalline trehalose (Control)

Figure 19:
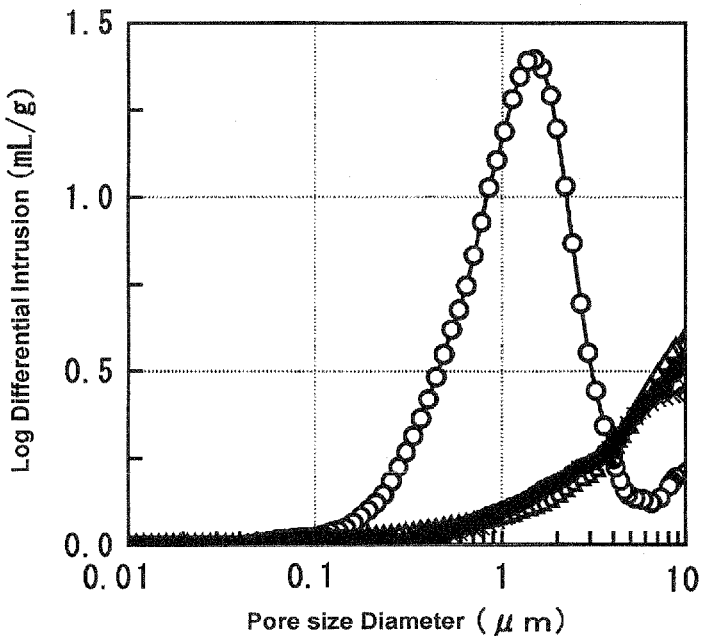
FIG. 19 shows the pore size distribution of the porous anhydrous crystalline maltose, measured by the mercury filling method.

In FIG. 19,

○: Porous anhydrous crystalline maltose obtained by treating at 70° C. for 480 min x: Hydrous crystalline β-maltose (Control)

Δ: Anhydrous crystalline α-maltose (Control)

●: Anhydrous crystalline β-maltose (Control)

Figure 20:
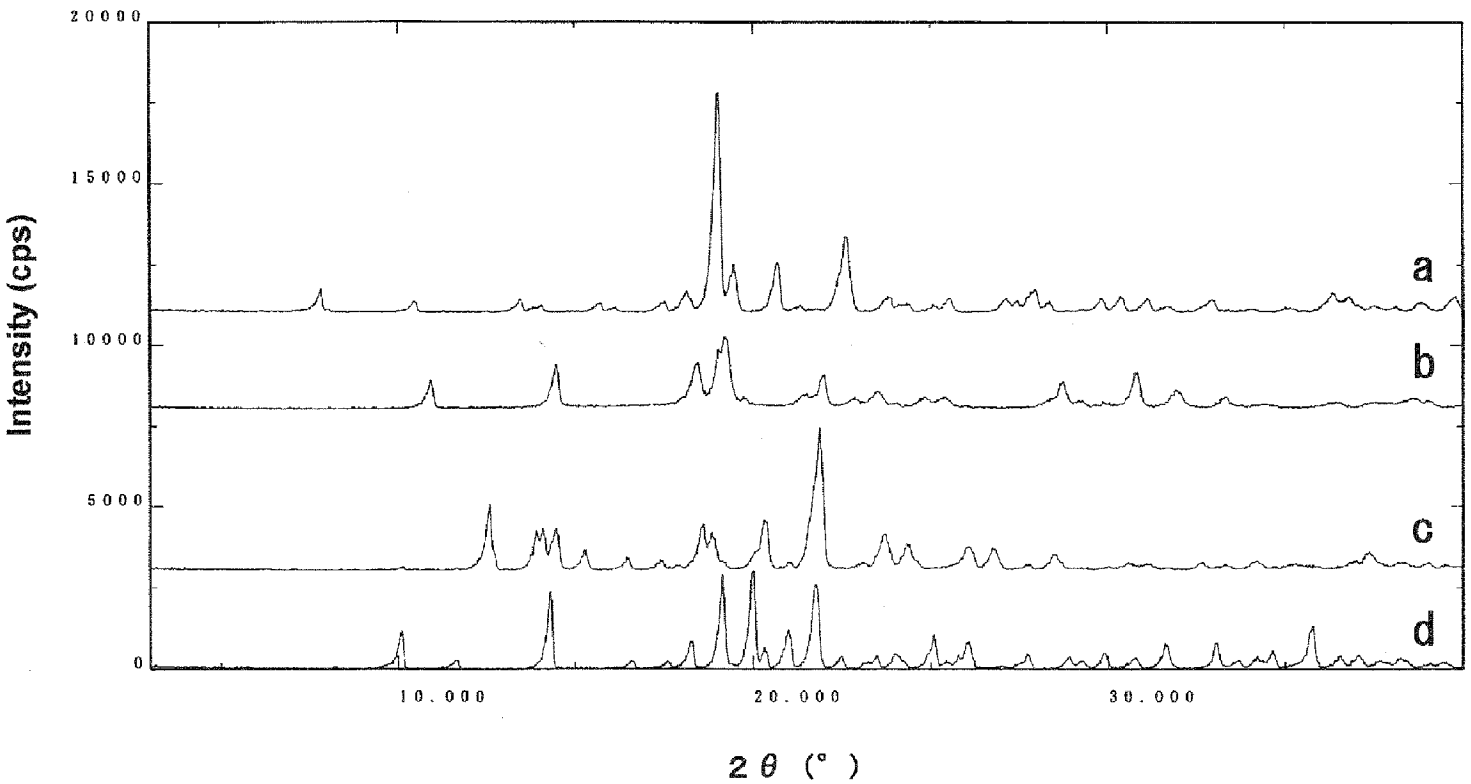
FIG. 20 shows the powdery X-ray diffraction diagram of the porous anhydrous crystalline maltose and those of anhydrous or hydrous crystalline maltose of the controls.

In FIG. 20, a: Porous anhydrous crystalline maltose obtained by treating at 70° C. for 480 min b: Anhydrous crystalline β-maltose (Control)

c: Anhydrous crystalline α-maltose (Control)

d: Hydrous crystalline β-maltose (Control)

Figure 21:
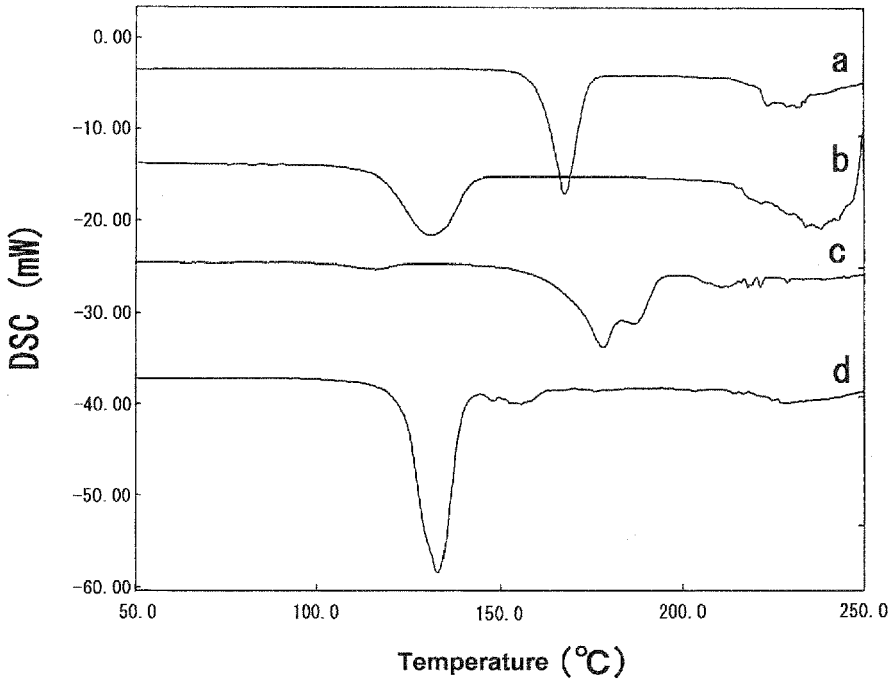
FIG. 21 shows the endothermic pattern on differential scanning calorimetry (DSC) of the porous anhydrous crystalline maltose and that of the control anhydrous crystalline maltose.

In FIG. 21, a: Porous anhydrous crystalline maltose obtained by treating at 70° C. for 480 min b: Anhydrous crystalline β-maltose (Control)

c: Anhydrous crystalline α-maltose (Control)

d: Hydrous crystalline β-maltose (Control)

Figure 24:
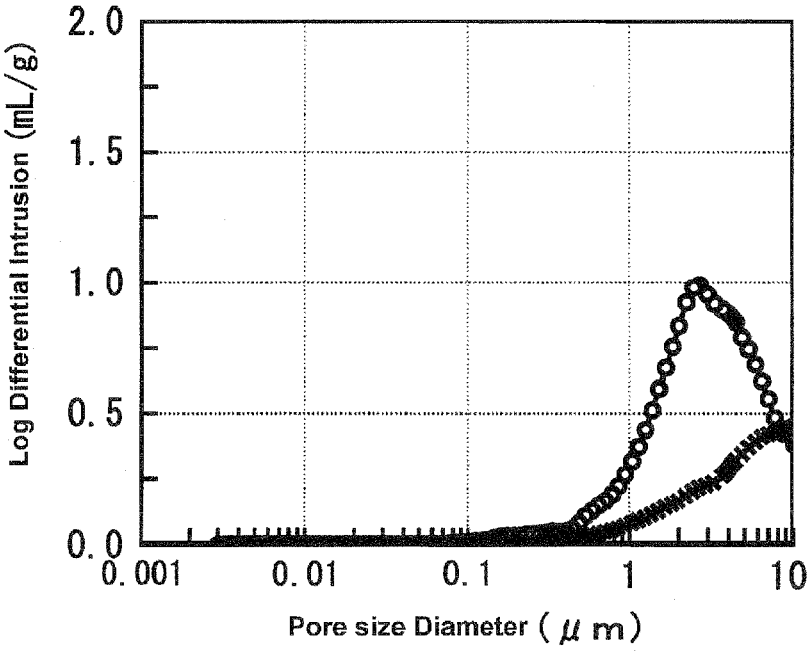
FIG. 24 shows the pore size distribution of the porous hydrous crystalline maltose, measured by the mercury filling method.

In FIG. 24,

○: Porous hydrous crystalline maltose x: Hydrous crystalline maltose (Control)

Figure 25:
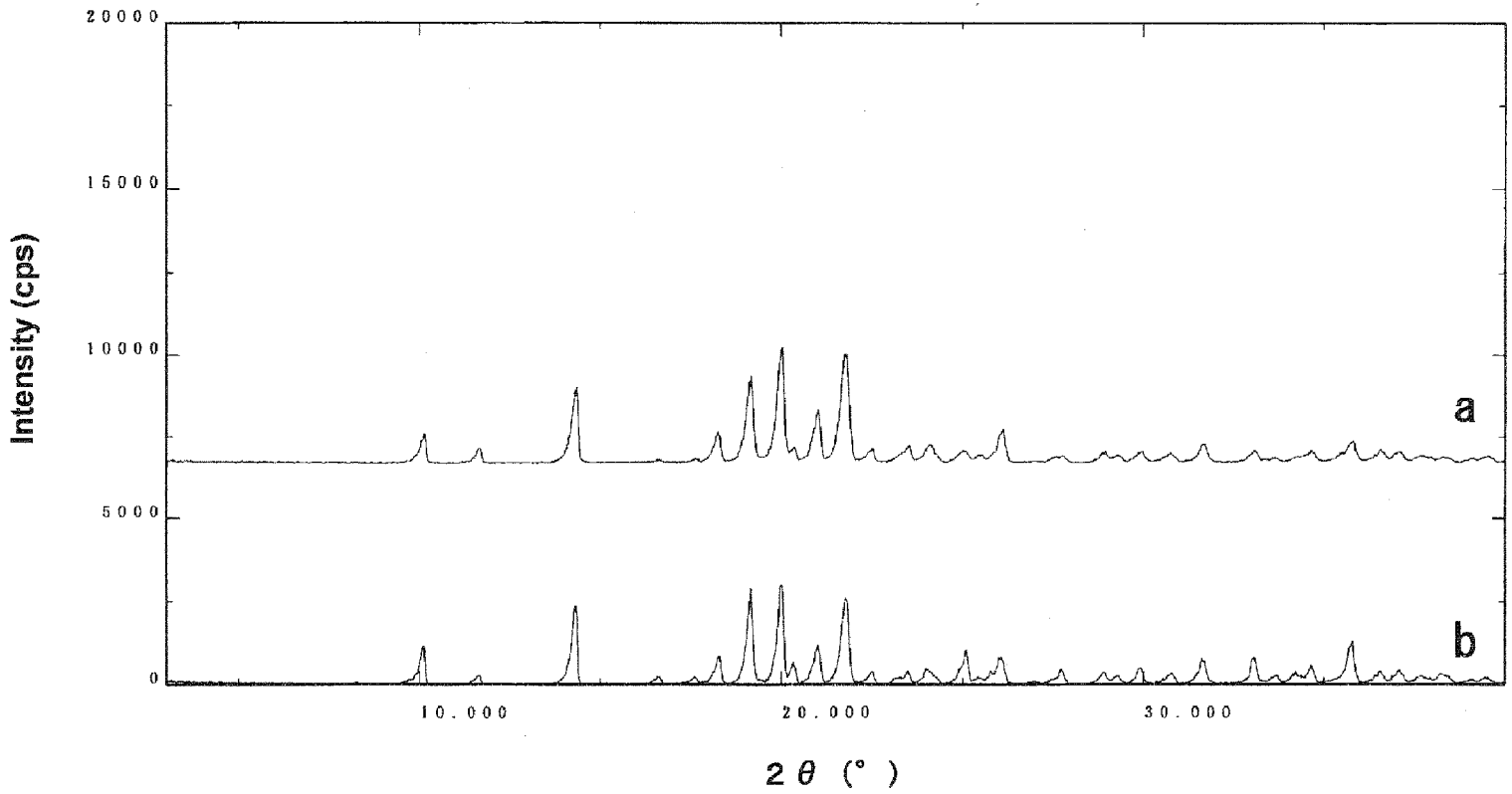
FIG. 25 shows the powdery X-ray diffraction diagram of the porous hydrous crystalline maltose and that of the control hydrous crystalline maltose.
Figure 26:
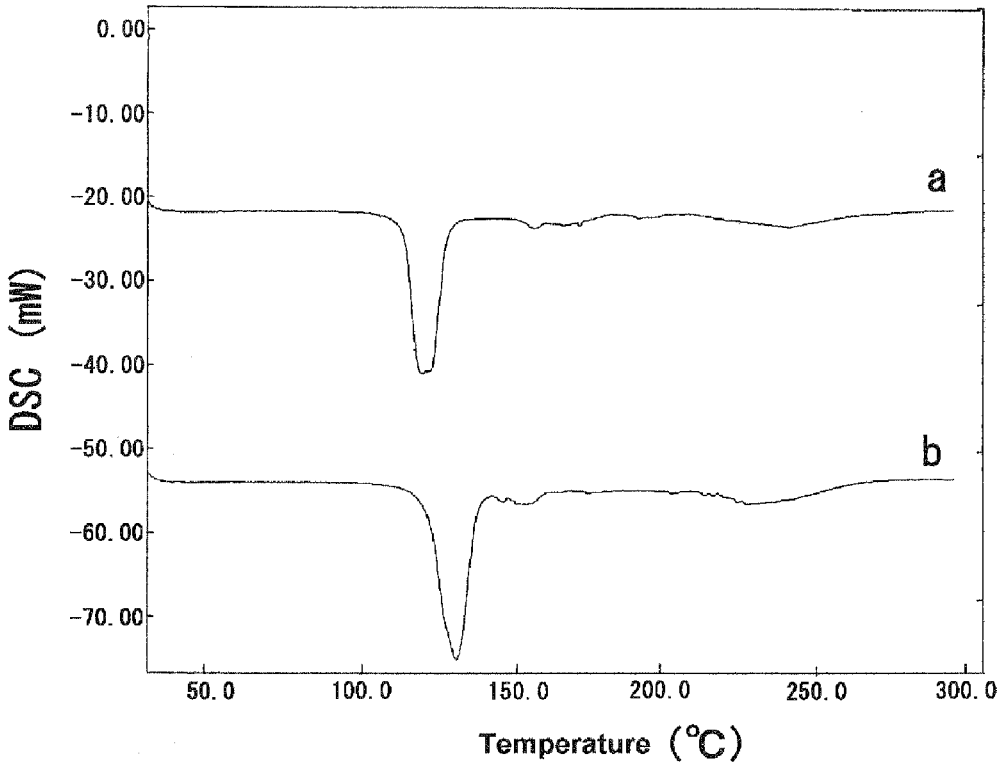
FIG. 26 shows the endothermic pattern on differential scanning calorimetry (DSC) of the porous hydrous crystalline maltose and that of the control hydrous crystalline maltose.

In FIGS. 25 and 26, a: Porous hydrous crystalline maltose b: Hydrous crystalline maltose (Control)

BEST MODE FOR CARRYING OUT THE INVENTION

The porous crystalline saccharide as referred to as in the present invention means a saccharide in the form of crystal, having a number of pores, specifically, a crystalline saccharide showing a number of pores when taking the photograph of it with a scale factor of, for example, 2,000-folds using a scanning electron microscope (SEM).

Since the porous crystalline saccharide of the present invention has a number of pores, it has a relatively large specific surface area and specific pore size distribution. Specifically, the porous crystalline saccharide of the present invention has the unique physical properties as follows:

(a) the specific surface area is 1 $m^2/g$ or higher when determined by the gas adsorption isotherms using nitrogen (hereinafter, called as "the nitrogen adsorption isotherms); and (b) the intrusion volume of the pores is 0.1 ml/g or higher and the pores show a clear peak in a range of the pore size diameter of lower than 5 μm, when the pore size distribution is measured by the mercury filling method.

The porous crystalline saccharide of the present invention is not restricted by its structure and hydrous or anhydrous form. Any crystalline saccharide is included by the present invention as far as it has a number of pores and the characteristics described above. The porous crystalline saccharide of the present invention can be obtained from any crystalline saccharide having hydrous crystalline form, for example, monosaccharides such as L-rhamnose, D-glucose, galactose etc.; disaccharides such as maltose, trehalose, melibiose, lactose, leucrose, palatinose, sophorose, laminaribiose, etc.; trisaccharides such as erlose, melezitose, planteose, raffinose, etc.; tetrasaccharides such as stachyose, cyclic tetrasaccharide having a structure of cyclo{→6)-α-D-glucopyranosyl-(1→3)-α-D-glucopyranosyl-(1→6)-α-D-glucopyranosyl -(1→3)-α-D-glucopyranosyl-(1→}, cyclic maltosylmaltose having a structure of cyclo{→6)-α-D-glucopyranosyl-(1→4)-α-D-glucopyranosyl-(1→6)-α-D-glucopyranosyl-(1→4)-α-D-glucopyranosyl-(1→}, etc.; and α-, β-, and γ-cyclodextrin.

Among the porous crystalline saccharides of the present invention, porous anhydrous crystalline saccharide can be produced by dehydrating the hydrous crystalline saccharide in an organic solvent at an ambient temperature of higher. As the organic solvent, it is preferable to use, usually, an organic solvent with a relatively high polarity and being easily blended in water such as alcohols and acetone, desirably, an alcohol aqueous solution with an alcohol content of 85% or higher, more desirably, an ethanol aqueous solution with an ethanol content of 85% or higher. In this specification, the method for dehydrating hydrous crystalline saccharide using ethanol may be called as "ethanol conversion".

When hydrous crystalline saccharide is dehydrated, the ratio of the hydrous crystalline saccharide and the organic solvent is not restricted as far as the object can be attained. In the case of using ethanol as the organic solvent, the preferable volume of ethanol to the weight of hydrous crystalline saccharide is, usually, 5-folds or higher, desirably, 10-folds or higher. The temperature for the dehydration is not restricted as far as the temperature is an ambient temperature or higher, but it is preferable to control the temperature, usually, 40° C. or higher, desirably, 50° C. or higher, more desirably, 60° C. or higher. In the dehydration, it is preferable to stir the organic solvent suspended hydrous crystalline saccharide for the efficient dehydration. After the dehydration, the organic solvent used for dehydrating hydrous crystalline saccharide contains water, but the solvent is reusable after distillation.

Among the porous crystalline saccharide of the present invention, the porous hydrous crystalline saccharide can be obtained by allowing the corresponding porous anhydrous crystalline saccharide to absorb moisture and drying. The method for allowing the porous anhydrous crystalline saccharide to absorb moisture is not restricted by the specific method. The method for keeping the porous anhydrous crystalline saccharide in a humidity-controlled condition for sufficient times to convert into hydrous crystalline saccharide; for example, in a constant temperature and humidity oven or a humidity-controlled desiccater with a relative humidity of 80% or higher, containing saturated aqueous solution of metal salts such as potassium chloride, barium chloride, potassium nitrate, potassium sulfate, and potassium bichromate; can be arbitrarily used.

Since the porous crystalline saccharide of the present invention has a number of pores and large specific surface area, it exhibits good solubility in water in comparison with the well-known crystalline saccharides. Particularly, it can be rapidly dissolved in cold water. Also, since the porous crystalline saccharide of the present invention has a high-affinity to oily substances, it is useful as a base material for powderizing oily substances.

The porous crystalline saccharide of the present invention can be applied for various uses by using the physical properties, i.e., a number of pores, large specific surface area, and large intrusion volume. For example, various useful materials can be stabilized by enclosing the useful material in the pores of the porous crystalline saccharide. Also, the porous crystalline saccharide can be used as a microcapsule by enclosing volatile fragrances in the pores and sealing the pores by coating. Further, since the porous crystalline saccharide contains air in the pores, it has a whipping property and can be used for preparing fine whipped cream.

Rightfully, the porous crystalline saccharide of the present invention can be used in the fields of foods and beverages, cosmetics, medicated cosmetics, and pharmaceuticals as in the cases of well-known crystalline saccharides.

The following examples explain the present invention in detail. However, the present invention is not restricted by them.

EXAMPLE 1

Preparation of the Porous Anhydrous Crystalline Trehalose from Hydrous Crystalline Trehalose In a 2-L round bottom flask attached with a stirrer and a thermometer, 1,200 ml of ethanol was placed and preheated at 50° C., 60° C., or 70° C. Then, 120 g of "TREHA®", a hydrous crystalline trehalose product with a trehalose purity of 99.2%, commercialized by Hayshibara Shoji Inc., Okayama, Japan, was admixed with the preheated ethanol and stirred at 170 rpm. At constant intervals, about 100 ml each of the crystal suspension was withdrawn and centrifuged to separate solid and liquid using a basket-type centrifugal separator, and the ethanol adherent to the crystal surface was removed by spreading the collected crystal onto a palette and drying in a circulation dryer at 50° C. for 20 min. The moisture content of the resulting crystal was measured by the conventional Karl Fischer's method. Effects of the temperatures of the ethanol treatment on the time course of the moisture content of the crystalline trehalose are shown in Table 1 and FIG. 1.

TABLE 1

| Temperature of ethanol treatment | | | | | |
|---|---|---|---|---|---|
| 50° C. | | 60° C. | | 70° C. | |
| Time (min) | Crystal moisture content (%, w/w) | Time (min) | Crystal moisture content (%, w/w) | Time (min) | Crystal moisture content (%, w/w) |
| 0 | 9.65 | 0 | 9.53 | 0 | 9.53 |
| 180 | 9.65 | 25 | 9.36 | 11 | 9.15 |
| 240 | 9.76 | 80 | 9.34 | 15 | 9.46 |
| 350 | 9.70 | 90 | 8.57 | 20 | 9.36 |
| 365 | 9.28 | 100 | 1.05 | 25 | 2.35 |

TABLE 1-continued

| Temperature of ethanol treatment | | | | | |
|---|---|---|---|---|---|
| 50° C. | | 60° C. | | 70° C. | |
| Time (min) | Crystal moisture content (%, w/w) | Time (min) | Crystal moisture content (%, w/w) | Time (min) | Crystal moisture content (%, w/w) |
| 390 | 7.83 | 110 | 0.98 | 30 | 0.49 |
| 405 | 1.07 | 120 | 1.24 | 40 | 1.22 |
| 420 | 1.35 | 130 | 0.73 | 50 | 0.70 |
| 465 | 0.55 | 150 | 1.08 | 60 | 0.24 |

As is evident from Table 1 and FIG. 1, although the time required for the dehydration was different with the difference of the treatment temperature, i.e., about 400 min at 50° C., about 100 min at 60° C., and about 30 min at 70° C.; it was revealed that the moisture contents of hydrous crystalline trehalose were decreased to about 1% (w/w) and the hydrous crystalline trehalose was converted into anhydrous crystalline trehalose. It was also found that a number of pores were formed in crystals accompanying with the decrease of the moisture content when the crystals obtained by the dehydration were observed by the scanning electron microscope (SEM).

Figure 2:
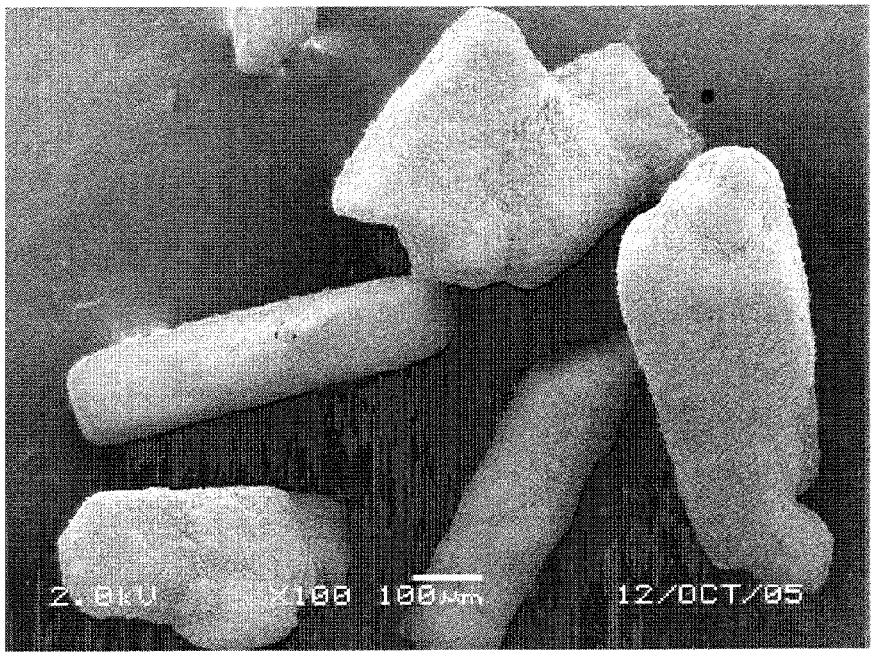
FIG. 2 shows the SEM photograph (×100) of the anhydrous crystalline trehalose obtained by treating in ethanol at 70° C. for 60 min.
Figure 3:
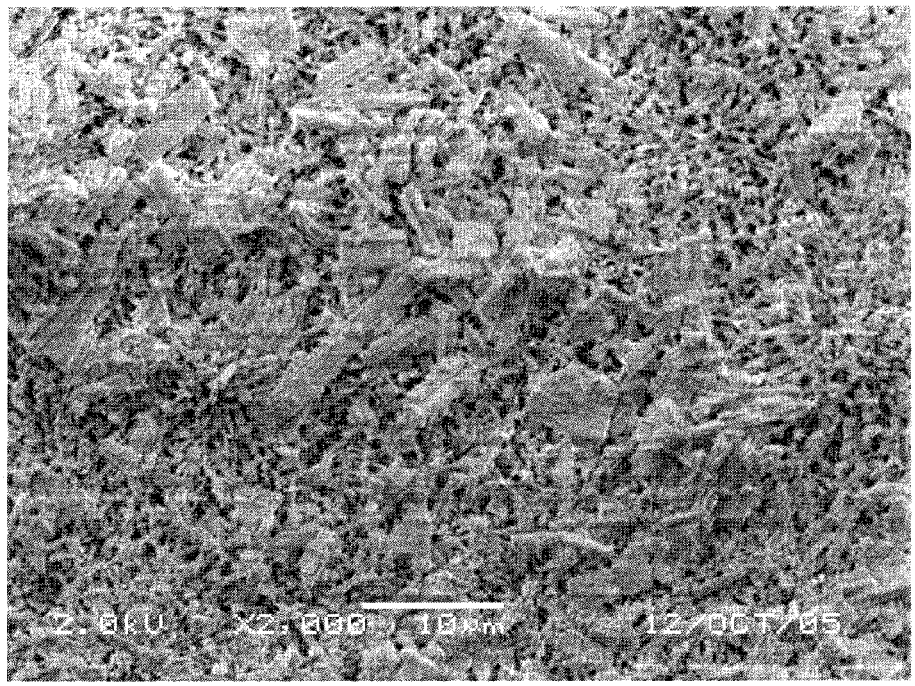
FIG. 3 shows the SEM photograph (×2,000) of the anhydrous crystalline trehalose obtained by treating in ethanol at 70° C. for 60 min.
Figure 4:
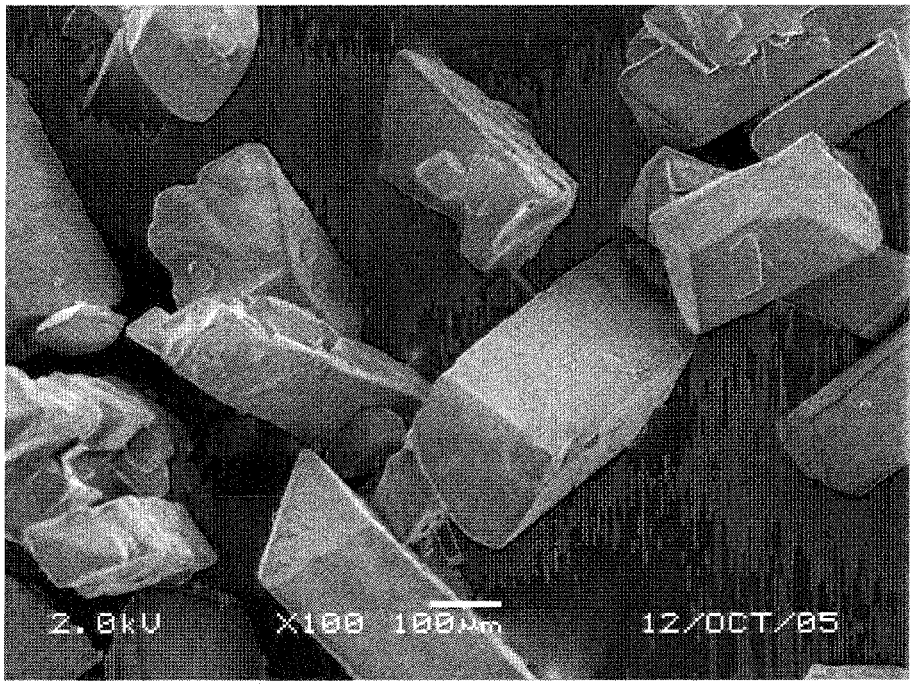
FIG. 4 shows the SEM photograph (×100) of the material hydrous crystalline trehalose.

SEM photographs of the anhydrous crystalline trehalose, obtained by treating in ethanol at 70° C. for 60 min, are shown in FIG. 2 (×100) and FIG. 3 (×2,000). Similarly, SEM photographs of the material hydrous crystalline trehalose and the anhydrous crystalline trehalose, prepared by drying in vacuo according to the conventional method, are shown in FIGS. 4 and 5, and FIGS. 6 and 7, respectively.

Figure 5:
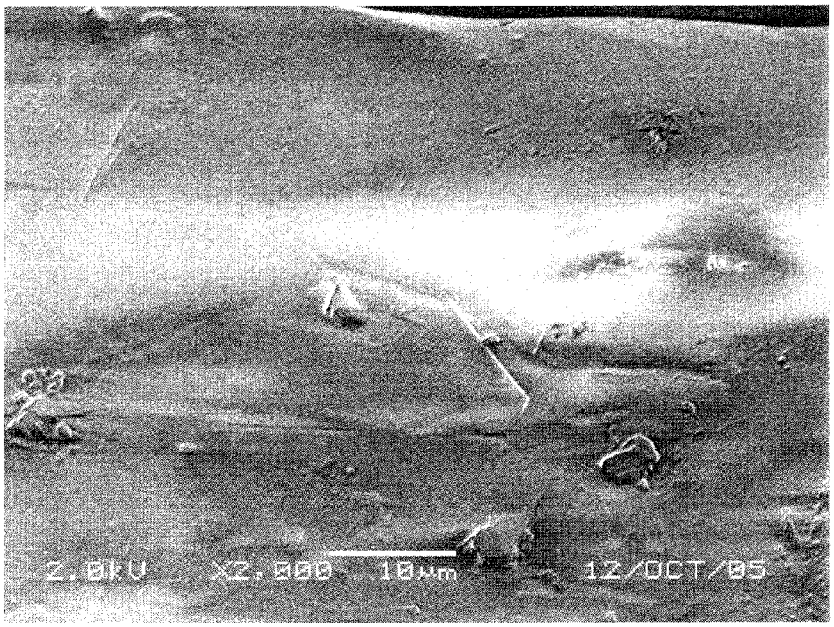
FIG. 5 shows the SEM photograph (×2,000) of the material hydrous crystalline trehalose.
Figure 6:
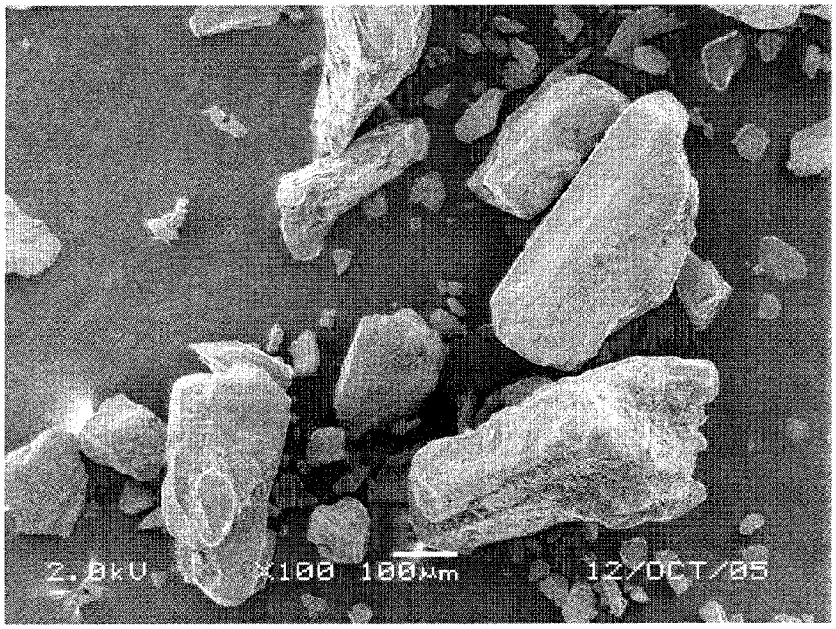
FIG. 6 shows the SEM photograph (×100) of the control anhydrous crystalline trehalose.
Figure 7:
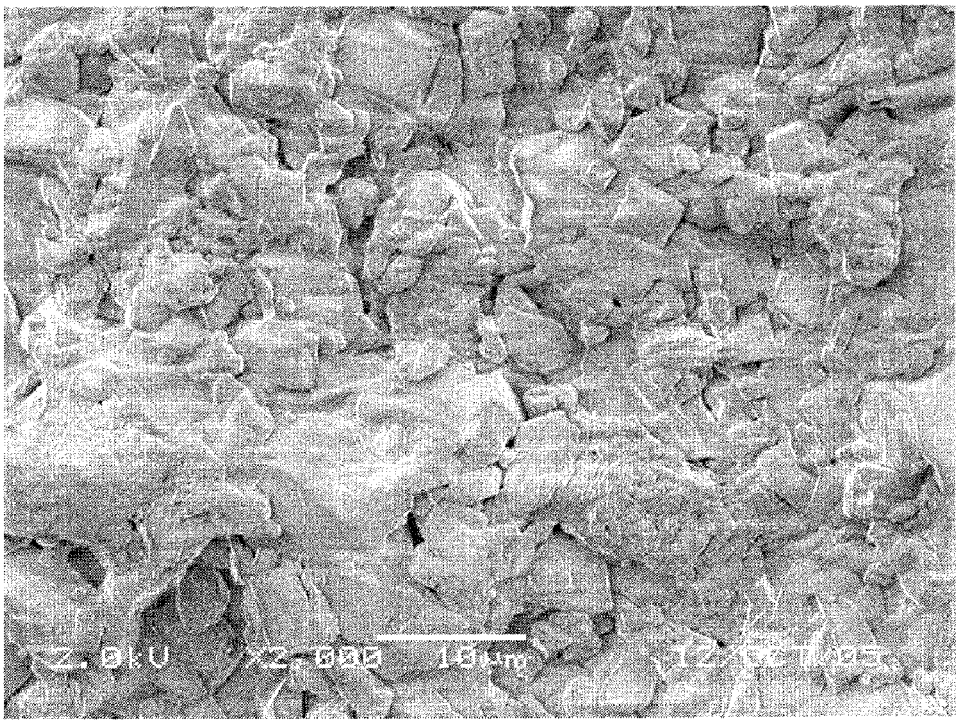
FIG. 7 shows the SEM photograph (×2,000) of the control anhydrous crystalline trehalose.

The surface of the crystal of the material hydrous crystalline trehalose was smooth plate-like form (Ref. FIG. 5), and that of anhydrous crystalline trehalose, prepared by the conventional method, was an aggregate of fine plate-like crystals (Ref. FIG. 7). While, a number of pores were detected on the surface of the anhydrous crystalline trehalose, obtained by the ethanol conversion (Ref. FIG. 3). The anhydrous crystalline trehalose, obtained by dehydrating hydrous crystalline trehalose in ethanol, was a novel porous anhydrous crystalline saccharide. The surfaces of the crystals of anhydrous crystalline trehaloses, dehydrated at 50° C. or 60° C., were also observed with the same manner, revealing that the crystals are porous anhydrous crystals.

EXAMPLE 2

Physical Properties of the Porous Anhydrous Crystalline Trehalose

Specific surface area, pore size distribution, powdery X-ray diffraction diagram, and endothermic pattern on differential scanning calorimetry of the porous anhydrous crystalline trehalose, obtained in Example 1, were measured.

EXAMPLE 2-1

Specific Surface Area of the Porous Anhydrous Crystalline Trehalose

Specific surface area of the porous anhydrous crystalline trehalose was measured by the nitrogen adsorption isotherms using "MODEL ASAP-2400", a specific surface area/pore size distribution analyzer commercialized by Micromeritics, Georgia, USA. About 3 g each of the porous anhydrous crystalline trehalose, obtained by treating in ethanol at 50° C. for 456 min or at 70° C. for 60 min in Example 1, was dried in the apparatus under reduced pressure at about 40° C. for about 15 hours as a pretreatment, and then used for the measurement of specific surface area by the nitrogen adsorption isotherms. The result was analyzed by the BET (Brunnauer, Emmet, and Teller) method. The commercial anhydrous crystalline trehalose, a reagent grade, commercialized by Hayashibara Biochemical Laboratories Inc., Okayama, Japan, was used as a control. The results are in Table 2.

TABLE 2

| Sample | Specific surface area ($m^2/g$) |
|---|---|
| Anhydrous crystalline trehalose (Conventional product, Control) | 0.465 |
| Porous anhydrous crystalline trehalose (treated at 50° C. for 465 min) | 3.306 |
| Porous anhydrous crystalline trehalose (treated at 70° C. for 60 min) | 2.513 |

As is evident from the results in Table 2, it was revealed that the porous anhydrous crystalline trehalose, prepared by the ethanol conversion of the present invention, has a large specific surface area, i.e., about 5-folds or higher, in comparison with the control commercial anhydrous crystalline trehalose, prepared by the conventional method.

EXAMPLE 2-2

Pore Size Distribution of the Porous Anhydrous Crystalline Trehalose

Pore size distribution of the porous anhydrous crystalline trehalose was measured by the mercury filling method using "AUTOPORE 9520", a pore size distribution analyzer commercialized by Micromeritics, Georgia, USA. About 0.5 g each of the porous anhydrous crystalline trehalose, obtained by treating in ethanol at 50° C. for 456 min or at 70° C. for 60 min in Example 1, was sampled and the pore size distribution was measured using the initial pressure of 15 kPa. As in the case of Example 2-1, commercial anhydrous crystalline trehalose was used as the control. The results are in Table 3, and the pore size distribution charts are in FIG. 8.

TABLE 3

| Sample | Intrusion volume (ml/g) | Median pore diameter (μm) | Mode pore diameter (μm) | Remarks |
|---|---|---|---|---|
| Anhydrous crystalline trehalose (Control) | 0.03 | 0.40 | 0.46 | A small number of pores |
| Porous anhydrous crystalline trehalose (treated at 50° C. for 465 min) | 0.22 | 0.21 | 0.29 | Having clear pores |
| Porous anhydrous crystalline trehalose (treated at 70° C. for 60 min) | 0.28 | 0.29 | 0.20 | Having clear pores |

As is evident from Table 3 and FIG. 8, although a small number of pores were detected in the control anhydrous crystalline trehalose, the intrusion volume was small, i.e., 0.03 ml/g. While, two kinds of the porous anhydrous crystalline trehalose, prepared by the ethanol conversion, showed relatively large intrusion volumes, i.e., 0.22 and 0.28 ml/g. Further, they showed clear peaks in pore diameter of less than 5 μm in the pore size distribution chart (Ref. FIG. 8, Symbols ● and ○).

EXAMPLE 2-3

Powdery X-Ray Diffraction Diagram of the Porous Anhydrous Crystalline Trehalose

Powdery X-ray diffractometry of the crystalline trehalose was carried out using Cu—Kα radiation and "GEIGERFLEX RDA-IIB", a powdery X-ray diffractometer commercialized by Rigaku Co., Tokyo, Japan. The powdery X-ray diffraction diagrams of the porous anhydrous crystalline trehalose, prepared by treating in ethanol at 70° C. for 60 min in Example 1, the control anhydrous crystalline trehalose, and the control hydrous crystalline trehalose are shown in FIG. 9.

As is evident from FIG. 9, the powdery X-ray diffraction diagram of the porous anhydrous crystalline trehalose (FIG. 9, Symbol a) was virtually coincide with that of the control anhydrous crystalline trehalose (FIG. 9, Symbol b), and completely different from that of the control hydrous crystalline trehalose (FIG. 9, Symbol c). In the powdery X-ray diagram of the control anhydrous crystalline trehalose, some peaks, assumed to be originated from the hydrous crystalline trehalose, were observed, revealing that tiny amount of hydrous crystalline trehalose is present.

EXAMPLE 2-4

Differential Scanning Calorimetry of the Porous Anhydrous Crystalline Trehalose

The endothermic pattern on differential scanning calorimetry (DSC) of samples was measured using "DSC8230", a differential scanning calorimeter commercialized by Rigaku Co., Tokyo, Japan. The endothermic patterns of the porous anhydrous crystalline trehalose, prepared by treating in ethanol at 70° C. for 60 min in Example 1, and the control anhydrous crystalline trehalose are shown in FIG. 10.

In FIG. 10, the endothermic pattern of the porous anhydrous crystalline trehalose (FIG. 10, Symbol a) showed an endothermic peak around 200° C. as in the case of the control anhydrous crystalline trehalose (FIG. 10, Symbol b). Also, it showed no peak around 90° C. while that of the control anhydrous crystalline trehalose showed a small peak around 90° C. The endothermic peak around 90° C. is originated from hydrous crystalline trehalose present in the control anhydrous crystalline trehalose. Since the peak was not detected in the case of the porous anhydrous crystalline trehalose, it was revealed that the porous anhydrous crystalline trehalose is anhydrous crystal not substantially containing hydrous crystal.

EXPERIMENT 3

Preparation of Porous Anhydrous Crystalline Maltose

Anhydrous crystalline maltose was prepared by ethanol conversion according to the methods described in Example 1 except for using "MALTOSE OM", a maltose product with a maltose purity of 98% or higher produced by Hayashibara Co., Ltd., Okayama, Japan, as hydrous crystalline saccharide and setting the treatment temperature to 70° C. The time course of the crystal moisture content is shown in Table 4.

TABLE 4

| Time (min) | Crystal moisture content (%, w/w) |
|---|---|
| 0 | 5.24 |
| 40 | 5.51 |
| 55 | 5.28 |
| 90 | 5.43 |
| 130 | 5.30 |
| 160 | 5.38 |
| 180 | 5.01 |
| 210 | 4.34 |
| 240 | 3.68 |
| 270 | 2.85 |
| 330 | 1.38 |
| 480 | 0.32 |

In spite of the high treatment temperature, i.e., 70° C., the conversion of hydrous crystalline maltose into anhydrous crystalline maltose required the long time, about 480 min, which is different with the cases of trehalose in Example 1 completed in about 30 min. It was revealed that hydrous crystalline maltose as a hydrous crystalline saccharide can be converted into anhydrous crystalline maltose by the ethanol conversion.

Figure 11:
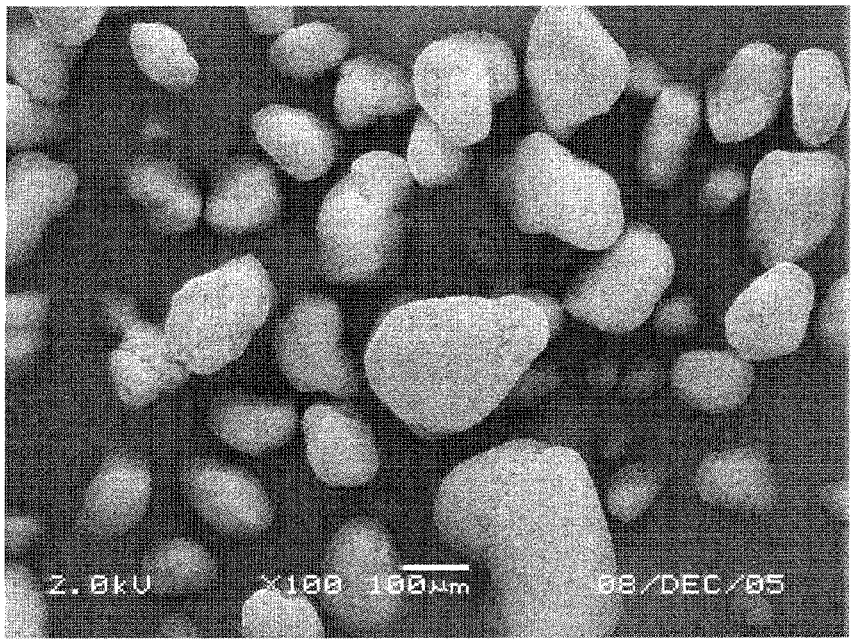
FIG. 11 shows the SEM photograph (×100) of the anhydrous crystalline maltose obtained by treating in ethanol at 70° C. for 480 min.
Figure 12:
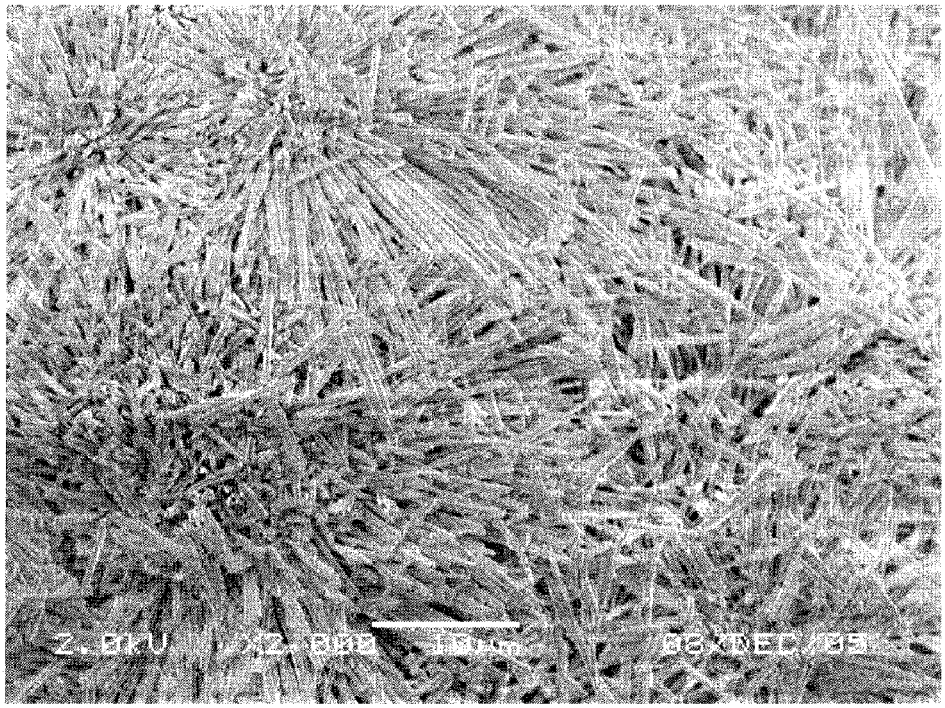
FIG. 12 shows the SEM photograph (×2,000) of the anhydrous crystalline maltose obtained by treating in ethanol at 70° C. for 480 min.
Figure 13:
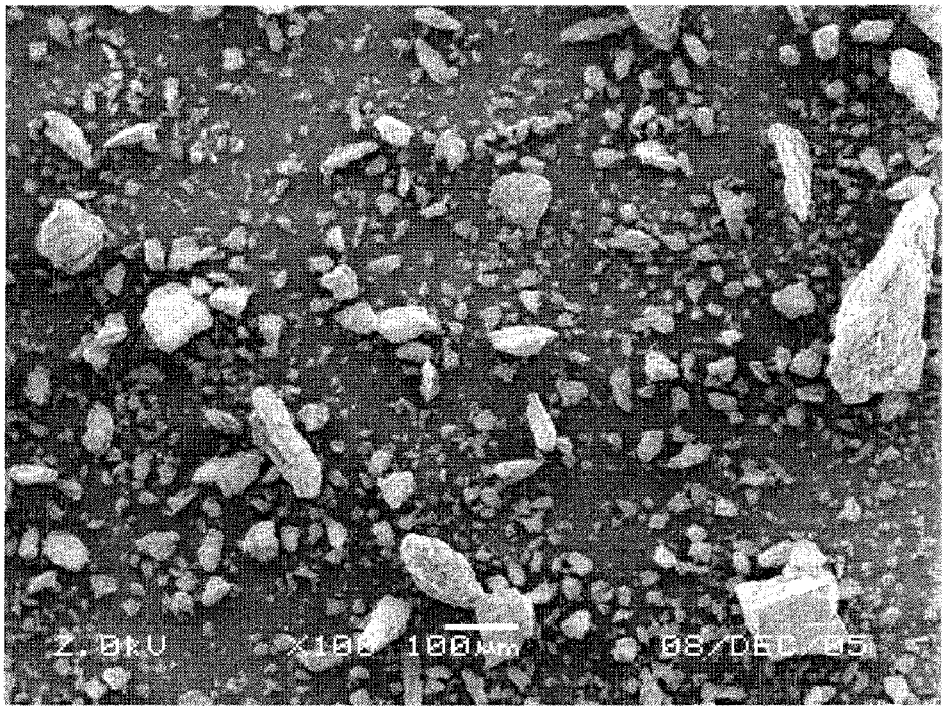
FIG. 13 shows the SEM photograph (×100) of the material hydrous crystalline maltose.

SEM photographs of the anhydrous crystalline maltose, treated for 480 min and described above, with scale factors of 100- and 2,000-folds, are shown in FIGS. 11 and 12, respectively. Also, SEM photographs with the same scale factors of the material hydrous crystalline β-maltose, anhydrous crystalline α-maltose and anhydrous crystalline β-maltose, both prepared by the conventional methods, are in FIGS. 13 and 14, FIGS. 15 and 16, and FIGS. 17 and 18, respectively.

Figure 14:
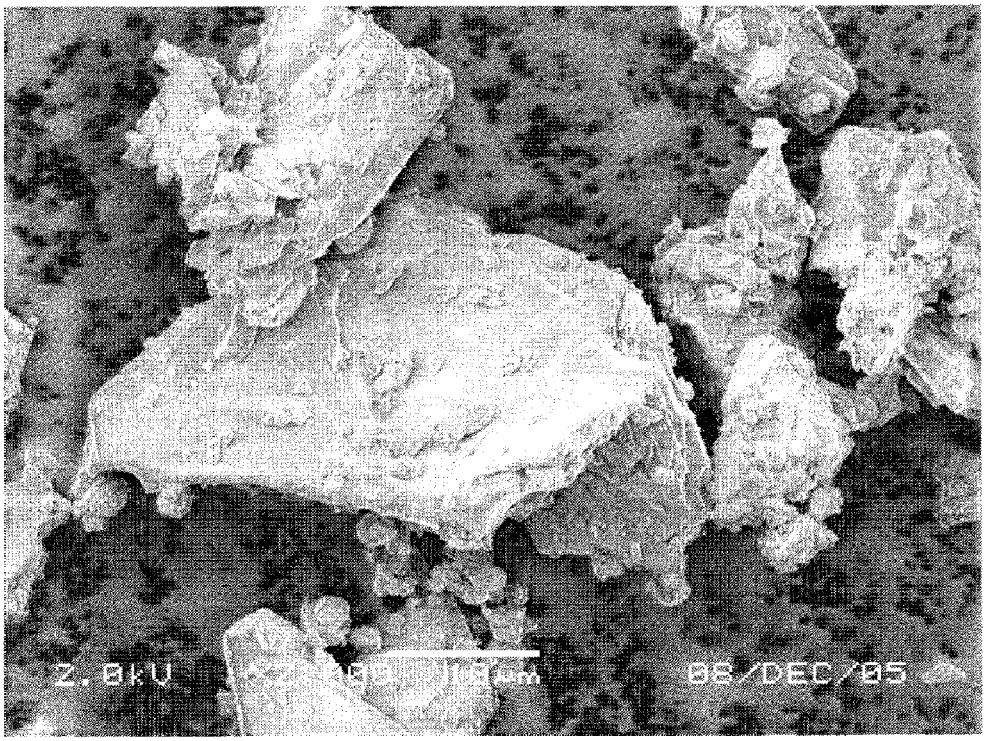
FIG. 14 shows the SEM photograph (×2,000) of the material hydrous crystalline maltose.
Figure 15:
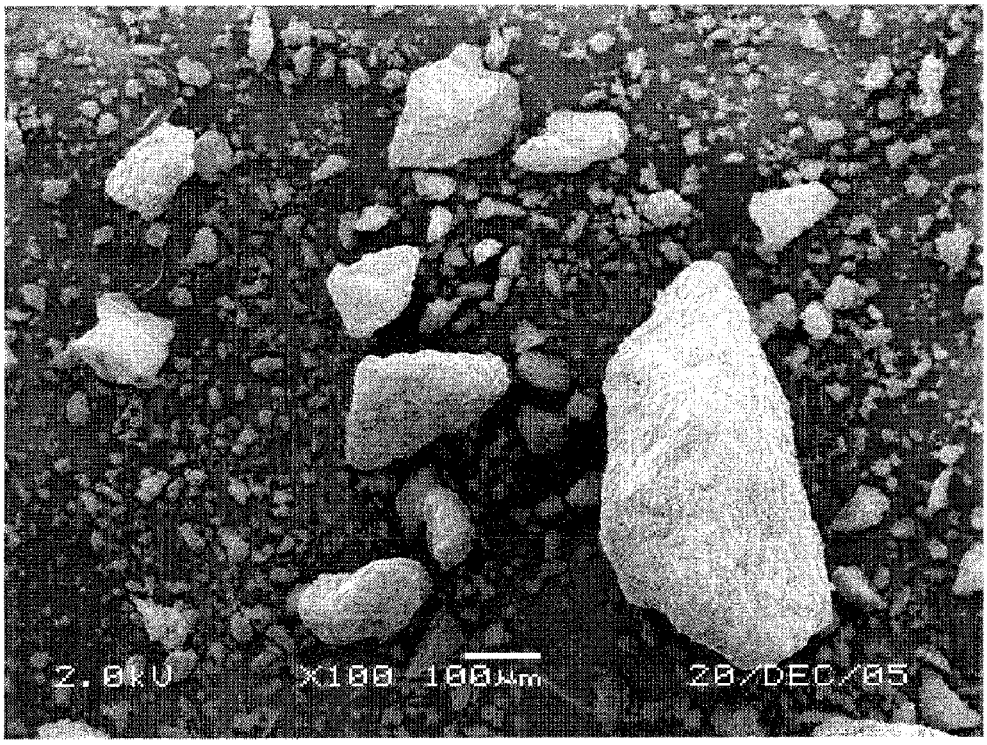
FIG. 15 shows the SEM photograph (×100) of the control anhydrous crystalline α-maltose.
Figure 16:
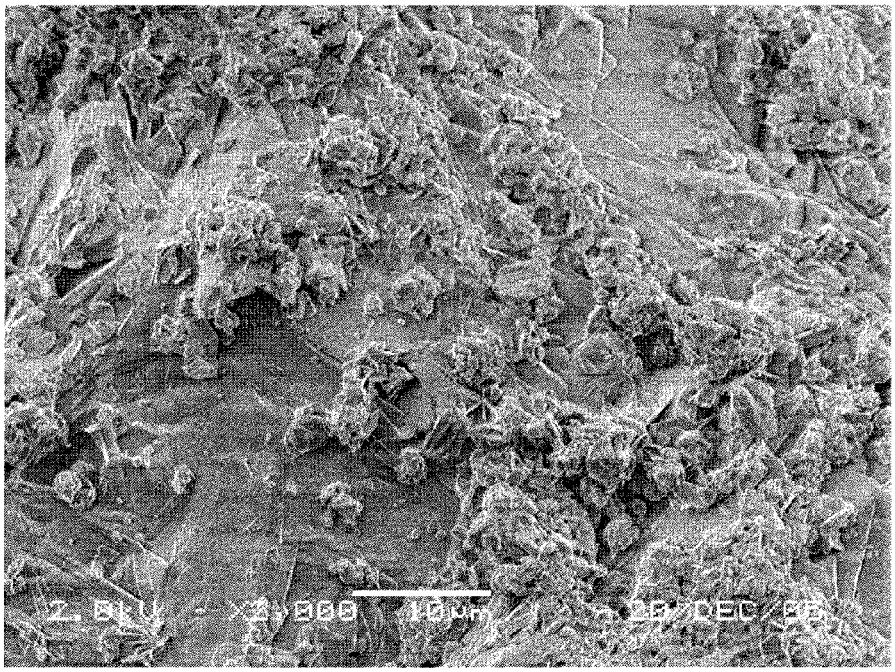
FIG. 16 shows the SEM photograph (×2,000) of the control anhydrous crystalline α-maltose.
Figure 17:
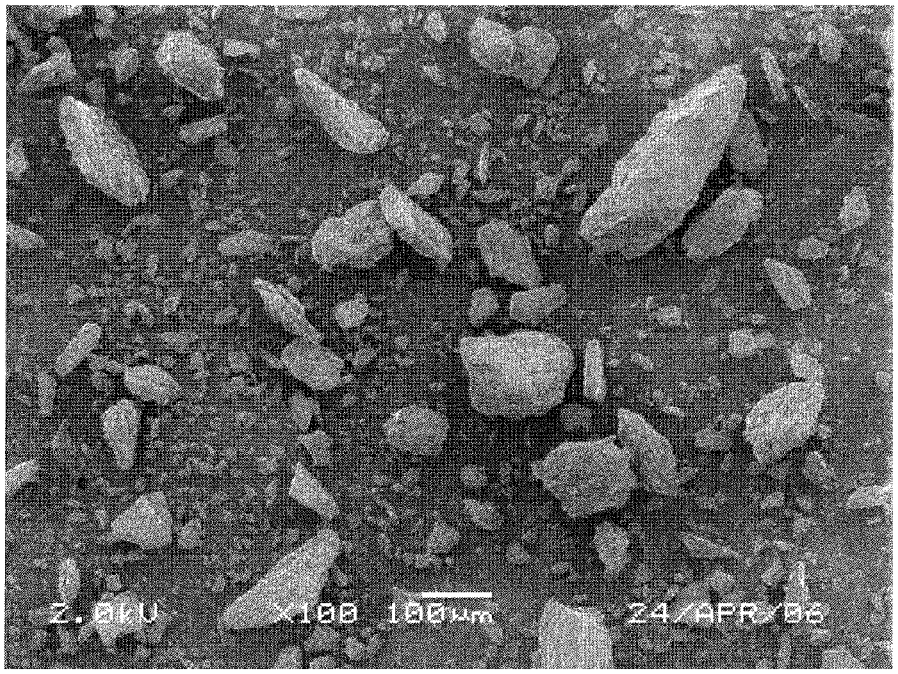
FIG. 17 shows the SEM photograph (×100) of the control anhydrous crystalline β-maltose.
Figure 18:
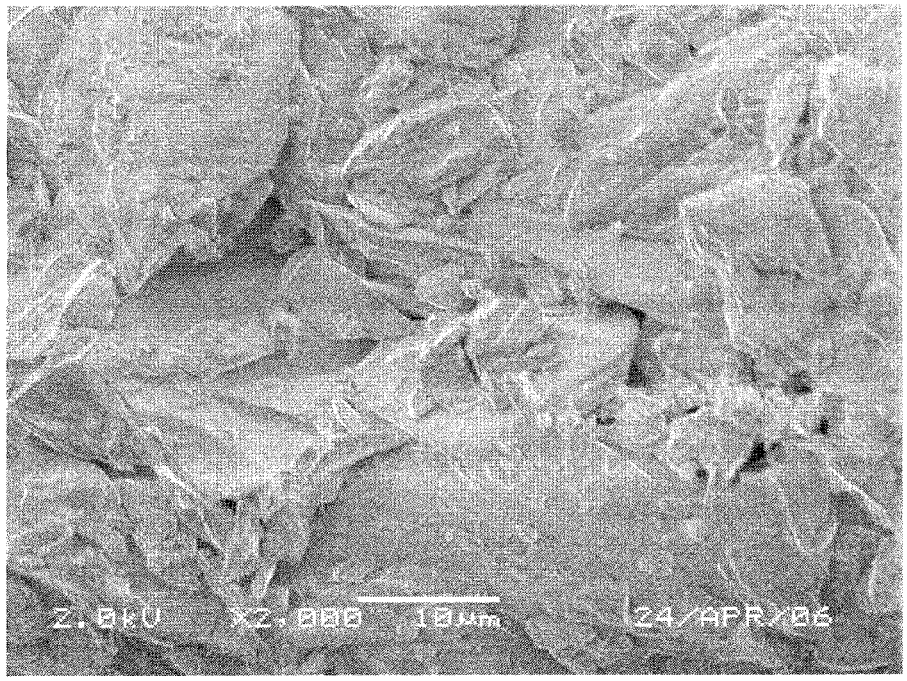
FIG. 18 shows the SEM photograph (×2,000) of the control anhydrous crystalline β-maltose.

As is evident from FIGS. 14, 16, and 18, pores were hardly observed in the material hydrous crystalline β-maltose and anhydrous crystalline α-maltose and anhydrous crystalline β-maltose, both prepared by the conventional methods. While, as shown in FIG. 12, the anhydrous crystalline maltose obtained by the ethanol conversion showed an aggregate of fine columnar crystals and a number of pores as in the case of the anhydrous crystalline trehalose in Example 1. It was revealed that the anhydrous crystalline maltose is a porous anhydrous crystalline saccharide.

EXAMPLE 4

Physical Properties of the Porous Anhydrous Crystalline Maltose

EXAMPLE 4-1

Specific Surface Area and Pore Size Distribution of the Porous Anhydrous Crystalline Maltose According to the methods in Example 2, the specific surface areas and the pore size distributions were measured using the porous anhydrous crystalline maltose, obtained by treating for 480 min in Example 3, as a sample and the material hydrous crystalline β-maltose and anhydrous crystalline α-maltose and anhydrous crystalline β-maltose, both prepared by the conventional methods, as controls. The results are summarized in Table 5. Further, those pore size distribution charts are in FIG. 19.

TABLE 5

| Sample | Specific surface area* ($m^2/g$) | Intrusion volume** (ml/g) | Median pore diameter** (μm) |
|---|---|---|---|
| Hydrous crystalline β-maltose (Control) | 0.46 | (No pore) | 11.20 |
| Anhydrous crystalline α-maltose (Control) | 0.48 | (No pore) | 13.00 |
| Anhydrous crystalline β-maltose (Control) | 0.82 | (No pore) | 14.70 |
| Porous anhydrous crystalline maltose | 3.39 | 1.05 | 1.26 |

*measured by the nitrogen adsorption isotherms
measured by the mercury filling method As is evident from Table 5, the specific surface area of the porous anhydrous crystalline maltose was 3.39 $m^2/g$, and those of the material hydrous crystalline β-maltose, anhydrous crystalline α-maltose, and anhydrous crystalline β-maltose were 0.46 $m^2/g$, 0.48 $m^2/g$, and 0.82 $m^2/g$, respectively. The specific surface area of the porous anhydrous crystalline maltose was about 4- to 7-folds larger than those of the controls. The porous anhydrous crystalline maltose showed a relatively large intrusion volume, i.e., 1.05 ml/g and a clear peak in the pore size diameter of less than 5 μm (FIG. 19, Symbol ○). In FIG. 19, the pore size distributions, observed in the material hydrous crystalline β-maltose, anhydrous crystalline α-maltose, and anhydrous crystalline β-maltose, (FIG. 19**, Symbols x, Δ, and ●) were not from pores and originated from the phenomenon of filling mercury to the space between crystal particles because of the small particle size.

EXAMPLE 4-2

Powdery X-Ray Diffraction Diagram of the Porous Anhydrous Crystalline Maltose

Powdery X-ray diffraction analysis of crystalline maltose was carried out according to the method in Example 2-3. The powdery X-ray diffraction diagrams of the porous anhydrous crystalline maltose, prepared by treating in ethanol at 70° C. for 480 min in Example 3, and those of hydrous crystalline β-maltose, anhydrous crystalline α-maltose, and anhydrous crystalline β-maltose as controls are shown in FIG. 20.

As is evident from FIG. 20, the powdery X-ray diffraction diagram of the porous anhydrous crystalline maltose (FIG. 20, Symbol a) was different from those of the control anhydrous crystalline β-maltose (FIG. 20, Symbol b), the control anhydrous α-maltose (FIG. 20, Symbol c), and hydrous crystalline maltose (FIG. 20, Symbol d). The fact indicates that the porous anhydrous crystalline maltose, obtained by the ethanol conversion, has a completely different crystal form from those of well-known anhydrous crystalline α-maltose and anhydrous crystalline β-maltose.

EXAMPLE 4-3

Differential Scanning Calorimetry of the Porous Anhydrous Crystalline Maltose

The endothermic pattern on the differential scanning calorimetry was measured according to the method in Example 2-4. The endothermic patterns on DSC analyses of the porous anhydrous crystalline maltose, prepared by treating in ethanol at 70° C. for 480 min in Example 3, and those of hydrous crystalline β-maltose, anhydrous crystalline α-maltose, and anhydrous crystalline β-maltose as controls are in FIG. 21.

In FIG. 21, the endothermic pattern of the porous anhydrous crystalline maltose (FIG. 21, Symbol a) on DSC analysis was different from those of the control anhydrous crystalline β-maltose (FIG. 21, Symbol b), the control anhydrous α-maltose (FIG. 21, Symbol c), and hydrous crystalline β-maltose (FIG. 21, Symbol d).

Since the powdery X-ray diffraction diagram and the endothermic pattern on DSC analysis of the porous anhydrous crystalline maltose were different from those of well-known anhydrous crystalline α-maltose and anhydrous crystalline β-maltose, it was presumed that the porous anhydrous crystalline maltose is a novel anhydrous crystalline maltose. Therefore, the melting point and the anomer content of maltose were determined.

EXAMPLE 4-4

Melting point of the porous anhydrous crystalline maltose

The melting point of the porous anhydrous crystalline maltose was measured by the conventional method using "MP-21", a melting-point apparatus commercialized by Yamato Scientific Co., Ltd., Tokyo, Japan, and the porous anhydrous crystalline maltose prepared by treating for 480 min in Example 3 as a sample. As a result, it was revealed that the melting point of the porous anhydrous crystalline maltose is 154 to 159° C. The value was lower than 168 to 175° C., the melting point of well-known anhydrous crystalline α-maltose (α/β complex crystal, α-anomer content of 73%) and higher than 120 to 125° C., the melting point of well-known anhydrous crystalline β-maltose.

EXAMPLE 4-5

Anomer Content of the Porous Anhydrous Crystalline Maltose

About 70 mg of the porous anhydrous crystalline maltose, obtained by treating for 480 min in Example 3, was dissolved in 5 ml of anhydrous pyridine. Then, 100 ml of the resulting solution was used for the conventional trimethylsiliyl derivatization (TMS-derivatization) and the resulting sample was analyzed by gas-chromatography to determine the contents of α-anomer and β-anomer by the simple area percentage method. The α-anomer and β-anomer contents of the porous anhydrous crystalline maltose, obtained in Example 3, were 5.5% and 94.5%, respectively, and the porous anhydrous crystalline maltose was made up of a majority of β-anomer. From the result, it was revealed that the porous anhydrous crystalline maltose is β-maltose.

From the results in Example 4, it was revealed that the porous anhydrous crystalline maltose, obtained in Example 3, is a novel anhydrous crystalline β-maltose different from the well-known anhydrous crystalline α-maltose and well-known anhydrous crystalline β-maltose.

From the results in Examples 1 to 4, it was revealed that novel anhydrous crystalline saccharides having a number of pores can be obtained by dehydrating hydrous crystalline saccharides in an organic solvent. In the following Examples 5 and 6 describe the preparation of a porous hydrous crystalline saccharide using the porous anhydrous crystalline saccharide as material and the physical properties of the resulting porous hydrous crystalline saccharide.

EXAMPLE 5

Preparation of Porous Hydrous Crystalline Saccharide

Hydrous crystalline saccharides were prepared from the respective porous anhydrous crystalline saccharide using the porous anhydrous crystalline trehalose, obtained by treating at 70° C. for 60 min in Example 1, and the porous anhydrous crystalline maltose, obtained by treating at 70° C. for 480 min in Example 3, as materials. About 50 g of the porous anhydrous crystalline saccharide and about 150 ml of deionized water were placed in respective container. Then, the both open containers were placed in the same closed vessel and leaved to stand at 27° C. for two days. By the treatment, the anhydrous crystalline saccharide was allowed to absorb moisture and converted into hydrous crystal. The resulting hydrous crystal was dried in a drying machine at 50° C. for one hour to remove excess moisture. The moisture contents of the porous anhydrous crystalline trehalose and the porous anhydrous crystalline maltose before and after the treatment to absorb moisture and after drying are in Table 6. The moisture content of crystals was measured by the conventional Karl Fischer's method.

TABLE 6

| Sample | Crystal moisture content (%, w/w) Before treatment | After treatment | After drying | Remarks |
|---|---|---|---|---|
| Porous anhydrous crystalline trehalose | 0.24 | 10.32 | 9.66 | Converted into crystalline di-hydrate |
| Porous anhydrous crystalline maltose | 0.32 | 7.35 | 5.14 | Converted into crystalline monohydrate |

In the case of the porous anhydrous crystalline trehalose, the moisture content after the steps of absorbing moisture and drying was 9.66%. From the result, it was revealed that the porous anhydrous crystalline trehalose was converted into hydrous crystalline trehalose. In the case of the porous anhydrous crystalline maltose, the moisture content after the steps of absorbing moisture and drying was 5.14%. From the result, it was revealed that the porous anhydrous crystalline maltose was converted into hydrous crystalline maltose.

Figure 22:
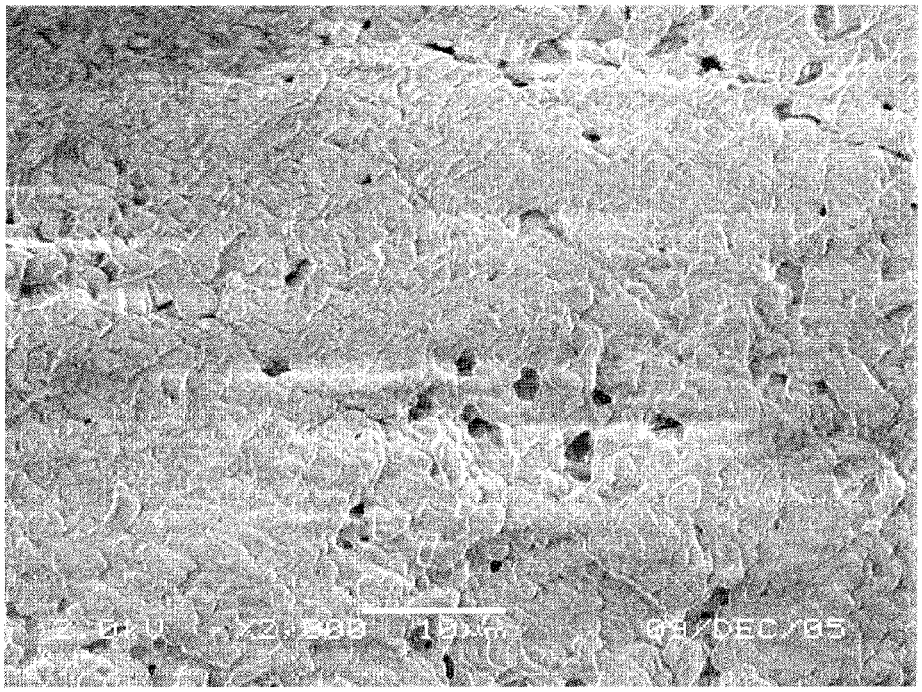
FIG. 22 shows the SEM photograph (×2,000) of the hydrous crystalline trehalose obtained by allowing the porous anhydrous crystalline trehalose to absorb moisture and drying.
Figure 23:
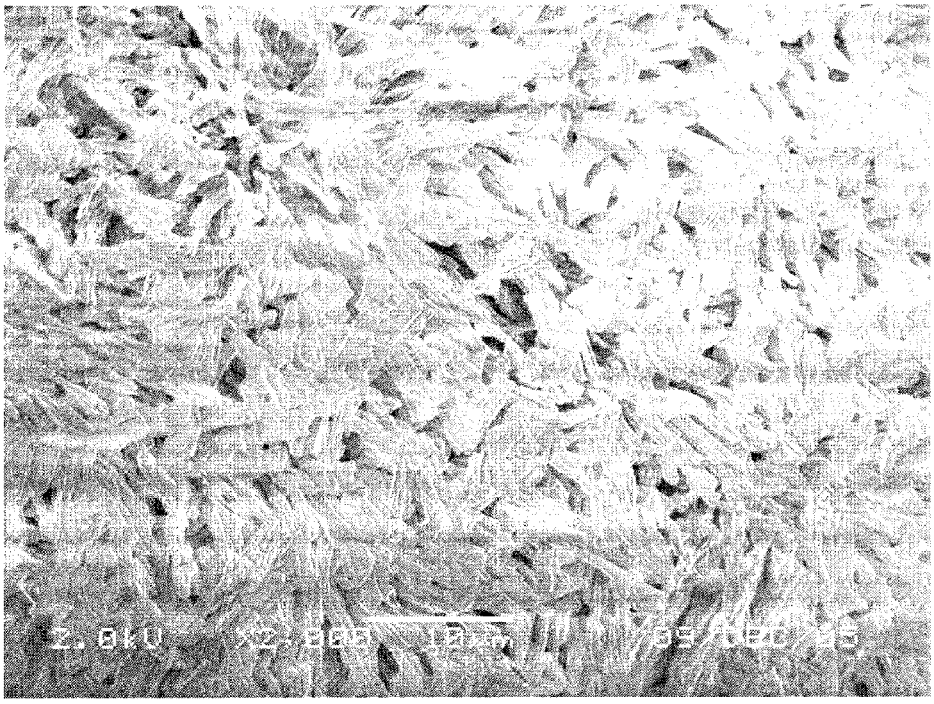
FIG. 23 shows the SEM photograph (×2,000) of the hydrous crystalline maltose obtained by allowing the porous anhydrous crystalline maltose to absorb moisture and drying.

SEM photographs (x 2,000) of the hydrous crystalline trehalose and the hydrous crystalline maltose, respectively prepared from the porous anhydrous crystalline trehalose and the porous anhydrous crystalline maltose, are shown in FIGS. 22 and 23. As is evident from FIG. 23, the hydrous crystalline maltose was a porous hydrous crystalline saccharide having a number of pores. While, as shown in FIG. 22, pores were not detected in the hydrous crystalline trehalose, and disappeared in the process of converting into hydrous crystal from anhydrous crystal. From the results, it was revealed that the porous anhydrous crystalline saccharide may be converted into the porous hydrous crystalline saccharide with keeping a number of pores, however, it depends on kinds of saccharides.

EXAMPLE 6

Physical Properties of the Porous Hydrous Crystalline Maltose

According to the methods in Example 2, the specific surface area, the pore size distribution, the powdery X-ray diffraction diagram, and endothermic pattern on DSC analysis were investigated using the porous hydrous crystalline maltose obtained in Example 5. The results of the analysis on the specific surface area and the pore size distribution are summarized in Table 7, and the pore size distribution chart was in FIG. 24. As a control, "MALTOSE OM", a hydrous crystalline maltose product with maltose purity of 98% or higher, produced by Hayashibara Co., Ltd., Okayama, Japan, was used.

TABLE 7

| Sample | Specific surface area* ($m^2$/g) | Intrusion volume** (ml/g) | Median pore diameter** (μm) |
|---|---|---|---|
| Hydrous crystalline β-maltose (Control) | 0.46 | (No pore) | 11.20 |
| Porous hydrous crystalline maltose | 1.39 | 0.77 | 2.82 |

*measured by the nitrogen adsorption isotherms

**measured by the mercury filling method

As is evident from Table 7, the specific surface area of the porous hydrous crystalline maltose was 1.39 $m^2$/g and was about 3-folds larger than that of the control hydrous crystalline β-maltose, i.e., 0.46 $m^2$/g. It was revealed that the pores were kept in the porous hydrous crystalline maltose and the maltose had a relatively large specific surface area and intrusion volume in comparison with the control hydrous crystalline β-maltose although the specific surface area of the porous anhydrous crystalline maltose was decreased by the conversion into hydrous crystal. The intrusion volume of the porous hydrous crystalline maltose was 0.77 ml/g, and in the pore size distribution chart (FIG. 24, Symbol ○), a clear peak was detected in the pore size diameter of less than 5 μm. In FIG. 24, the pore size distribution, observed in the control hydrous crystalline β-maltose (FIG. 24, Symbol x), was not from pores and originated from the phenomenon of filling mercury to the space between crystal particles because of the small particle size.

The powdery X-ray diffraction diagrams and endothermic patterns on DSC analysis of the porous hydrous crystalline maltose and the control hydrous crystalline β-maltose are shown in FIGS. 25 and 26, respectively. As is evident from FIG. 25, since the powdery X-ray diffraction diagram of the porous hydrous crystalline maltose is almost identical with that of the control hydrous crystalline β-maltose, it was revealed that the porous hydrous crystalline maltose is hydrous crystalline β-maltose. As shown in FIG. 26, the porous hydrous crystalline maltose showed the endothermic peak at slightly lower temperature than that of the control hydrous crystalline β-maltose on DSC analysis. The cause of the phenomenon is uncertain now, but it is thought that the phenomenon is caused from a number of pores in the porous hydrous crystalline maltose.

As is evident from the results in Examples 5 and 6, it was revealed that porous hydrous crystalline saccharide can be prepared by allowing the porous anhydrous crystalline saccharide to absorb moisture, but it depended on the kinds of saccharides. Also, it was revealed that the resulting porous hydrous crystalline saccharide has a large specific surface area, a large intrusion volume, and a specific pore size distribution as in the case of the material porous anhydrous crystalline saccharide. The following Examples 7 and 8 describe the comparison of the properties of the porous crystalline saccharides of the present invention and the well-known crystalline saccharides.

EXAMPLE 7

Rate of Dissolution of Porous Crystalline Saccharides Against Water

A dissolution test against cold water at 10° C. was carried out using the porous anhydrous crystalline trehalose prepared by treating at 70° C. for 60 min in Example 1, the porous anhydrous crystalline maltose prepared by the method in Example 3, and the porous hydrous crystalline maltose prepared by the method in Example 5, as samples. The results were compared with those of the controls, anhydrous crystalline trehalose, hydrous crystalline trehalose, and hydrous crystalline maltose.

Twenty milliliters of 10° C.-cold water was placed in a test tube with an internal diameter of 18 mm, and then stirred using a stirring bar. A crystalline saccharide sample was put into the test tube, and the time required for the complete dissolution (for the disappearance of precipitate particles) was measured. The amount of samples was set to be 0.5 g in the case of trehalose and to be 0.2 g in the case of maltose, and the stirring rate was set to be about 300 rpm in any case. The measurement of time for dissolution under the above conditions was carried out 5-times at each sample. The results are in Table 8.

TABLE 8

| | Time required for dissolution (sec) | | | | | |
|---|---|---|---|---|---|---|
| Sample | No. 1 | No. 2 | No. 3 | No. 4 | No. 5 | Average |
| Porous anhydrous crystalline trehalose (Present invention) | 29 | 34 | 40 | 29 | 31 | 33 |
| Anhydrous crystalline trehalose (Control) | 90 | 87 | 96 | 91 | 86 | 90 |
| Hydrous crystalline trehalose (Control) | 106 | 130 | 121 | 135 | 123 | 123 |
| Porous anhydrous crystalline β-maltose (Present invention) | 30 | 31 | 33 | 29 | 32 | 31 |
| Porous hydrous crystalline β-maltose (Present invention) | 67 | 66 | 64 | 68 | 65 | 66 |
| Anhydrous crystalline α-maltose (Control) | 37 | 35 | 39 | 38 | 36 | 37 |
| Hydrous crystalline β-maltose (Control) | 118 | 113 | 114 | 119 | 116 | 116 |

As is evident from the results in Table 8, it was revealed that the porous anhydrous crystalline trehalose, the porous anhydrous crystalline β-maltose, and the porous hydrous crystalline β-maltose were rapidly dissolved in cold water in comparison with the control anhydrous crystalline saccharide and hydrous crystalline saccharide, which have no pore.

EXAMPLE 8

Oil-Keeping Ability of the Porous Crystalline Saccharides

The oil-keeping ability of each crystalline saccharide was measured using the porous anhydrous crystalline trehalose prepared by treating at 70° C. for 60 min in Example 1, the control hydrous crystalline trehalose, and the control anhydrous crystalline trehalose as crystalline trehalose samples; and the porous anhydrous crystalline maltose prepared by the method in Example 3, the control hydrous crystalline β-maltose, and the control anhydrous crystalline α-maltose, and the control anhydrous crystalline β-maltose as crystalline maltose samples, and the results were compared.

The measurement of the oil-keeping ability of the crystalline saccharide was carried out according to the method disclosed in Japanese Patent Kokai No. 31,650/84. Five grams of "NISSHIN SALAD OIL", a salad oil commercialized by Nisshin OiliO Group, Ltd., Tokyo, Japan, was placed in a 50-ml plastic container, and then gradually admixed with each powdery crystalline saccharide with stirring. The mixture shows a flowability when the amount of the mixed saccharide is low, however, the viscosity of the mixture is increased with the increase of the amount of the mixed saccharide, and the mixture forms agglomerate in time. When the amount of the mixed saccharide is further increased, the agglomerate increase in solidity and then loosen. The point that the agglomerate is loosened is estimated to be the endpoint and the oil-keeping ability was calculated using the following formula. The results are summarized in Table 9.

Oil-Keeping Ability =(The amount of salad oil(5 g)/the amount of added PCS*)×100 *: Powdery crystalline saccharide tm Formula 1

TABLE 9

| Powdery crystalline saccharide | Oil-keeping ability |
|---|---|
| Hydrous crystalline trehalose (Control) | 38.5 |
| Anhydrous crystalline trehalose (Control) | 38.5 |
| Porous anhydrous crystalline trehalose (Present invention) | 62.5 |
| Hydrous crystalline maltose (Control) | 45.5 |
| Anhydrous crystalline α-maltose (Control) | 41.7 |
| Anhydrous crystalline β-maltose (Control) | 40 |
| Porous anhydrous crystalline β-maltose (Present invention) | 143 |

As is evident from the results in Table 9, the oil-keeping ability of both the control hydrous crystalline trehalose and the control anhydrous crystalline trehalose was 38.5 despite of the difference of hydrous and anhydrous crystal. While, the oil-keeping ability of the porous anhydrous crystalline trehalose was 62.5 and the value was about 1.6-folds larger than that of the control crystalline trehalose. In the case of using the crystalline maltose as samples, the oil-keeping ability of the control crystalline maltose was about 41 to 46, and that of the porous anhydrous crystalline β-maltose was 143, about 3-folds larger than that of the control. In either case of trehalose and maltose, the porous crystalline saccharide having a large specific surface area showed a high oil-keeping ability in comparison with the well-known crystalline saccharide, revealing that the porous crystalline saccharide has a high affinity with oils. The results indicate that the porous crystalline saccharide of the present invention is more useful as a powderizing base for oily substances.

EXAMPLE 9

Flax Seed Oil Powder

One part by weight of flax seed oil was admixed with 10 parts by weight of the porous anhydrous crystalline trehalose, prepared by treating at 70° C. for 60 min in Example 1, and then the mixture was kneaded to make into a powdery product. In the same manner, powdery products were prepared by using "TREHA®", hydrous crystalline trehalose commercialized by Hayashibara Shoji Inc., Okayama, Japan, and anhydrous crystalline trehalose, prepared from hydrous crystalline trehalose by drying in vacuo at a high temperature according to the conventional method, as controls. The flax seed oil powders, prepared by using the control hydrous crystalline trehalose or the control anhydrous crystalline trehalose as the base, could not keep powdery forms and flax seed oil oozed on the powder surface just after the preparation. While, the flax seed oil powder, prepared by using the porous anhydrous crystalline trehalose, showed no hygroscopicity and caking and kept good powdery form. The results support the results in Example 8, revealing that the porous crystalline saccharides have good oil-keeping abilities. The flaxseed oil powder can be preferably used as a supplement.

EXAMPLE 10

Preservation Test of the Flax Seed Oil Powder Prepared by Using the Porous Anhydrous Crystalline Trehalose As disclosed in Japanese Patent Kokai No. 123,195/2001 applied for by the same applicant of the present invention, it has been known that trehalose inhibits the decomposition of fatty acids and the formation of volatile aldehydes. Therefore, a preservation test of the flax seed oil powders were carried out according to the following method by using the flax seed oil powders prepared in Example 9 by using the porous anhydrous crystalline trehalose of the present invention or the control anhydrous crystalline trehalose as powderizing bases, and the amounts of the formed volatile aldehydes were compared.

One gram each of the flax seed oil powder was put into two 20 ml-vial, sealed with Butyl-rubber stopper, and then preserved in an incubator at 40° C. for three weeks. The vial was collected at the point of before the preservation or after preserving for 21 days and heated at 80° C. for 5 min. Then, 2 ml of vapor phase gas in the vial was directly subjected to gas chromatography (GC) analysis to determine the amount of volatile aldehydes. GC analysis was carried out according to the following conditions. The results are in Table 10.

(Conditions of GC Analysis)

Gas chromatograph: GC-17B, produced by Shimadzu Corporation, Kyoto, Japan;

Column: TC-FFAP capillary column (ID 0.52 mm×30 m), produced by GL Sciences Inc., Tokyo, Japan;

Column temperature: 40° C. to 100° C. (linearly increased 5° C./min);

Carrier gas: Helium; Linear velocity: 33 cm/sec;

Sample injection: Vapor phase gas 2 ml (split 1/30);

Detector: FID

TABLE 10

| | The amount of volatile aldehydes (μg/ml-vapor phase gas) | | | |
|---|---|---|---|---|
| | Anhydrous crystalline trehalose (Control) | | Porous anhydrous crystalline trehalose (Present invention) | |
| | Before preservation | 21 days after preservation | Before preservation | 21 days after preservation |
| Total aldehydes | 27.02 | 31.58 | 14.19 | 18.15 |
| Acetoaldehyde | 8.91 | 8.99 | 4.13 | 3.77 |
| Propanal | 10.24 | 12.98 | 5.77 | 8.66 |
| Butanal | 0.66 | 0.93 | 0.43 | 0.63 |
| Pentanal | 0.13 | 0.55 | 0.09 | 0.33 |
| Hexanal | 0.07 | 0.16 | 0.00 | 0.11 |
| 2-Hexenal | 0.00 | 0.02 | 0.00 | 0.01 |
| 2-Heptenal | 0.00 | 0.01 | 0.00 | 0.01 |

TABLE 10-continued

| | The amount of volatile aldehydes (μg/ml-vapor phase gas) | | | |
|---|---|---|---|---|
| | Anhydrous crystalline trehalose (Control) | | Porous anhydrous crystalline trehalose (Present invention) | |
| | Before preservation | 21 days after preservation | Before preservation | 21 days after preservation |
| 2-Octenal | 0.23 | 0.66 | 0.11 | 0.43 |
| 2-Nonenal | 0.01 | 0.27 | 0.00 | 0.19 |
| 2,4-Decadienal | 6.77 | 7.01 | 3.66 | 4.01 |

As is evident from the results in Table 10, in the case of the flax seed oil powder using the porous anhydrous crystalline trehalose as a powderyzing base, the amount of total volatile aldehydes in the vapor phase gas was small to be 50 to 60% in both cases of before and after preservation, in comparison with the case of the flax seed oil powder using the control anhydrous crystalline trehalose as a powderizing base. The reason was presumed that the volatile aldehydes were enfolded in pores and the volatilization of those to gas phase was inhibited because of the porous property of the base.

From the results in Examples 8 to 10, it was revealed that the porous crystalline saccharide of the present invention, particularly, the porous anhydrous crystalline trehalose can be advantageously used as a powderizing base for various oily substances as well as flax seed oil.

EXAMPLE 11

Powdery "Kurozu"

One part by weight of "kurozu" (unrefined brewed black vinegar produced from sweet potato) was admixed with nine parts by weight of the porous anhydrous crystalline trehalose, prepared by treating at 70° C. for 60 min in Example 1, and mixed using a universal mixing machine. Then, the resulting mixture was leaved to stand for overnight and pulverized to make into a powdery "kurozu" using the porous anhydrous crystalline trehalose as a powderizing base material. The product comprises about 6 mg-acetic acid/g-product and can be preferably used as a powdery "kurozu" for diet, which can be ingested continuously.

Industrial Applicability

According to the present invention, the porous crystalline saccharides having novel physical properties can be efficiently produced. Since the porous crystalline saccharides of the present invention have a number of pores, they have large specific surface areas. Accordingly, the porous crystalline saccharides can be contacted with water with those large touch areas and have strong affinities with oily substances. Further, since the porous crystalline saccharides of the present invention can be easily dissolved in beverages or foods such as coffee, yoghurt, and fruits at lower temperature, they can be used in the field of foods. It is also expected that the porous crystalline saccharides of the present invention can be used as not only saccharides but also as substances for the stabilization of useful substances and the microencapsulation of volatile fragrances and whipping agent. The present invention, establishing the porous crystalline saccharides and the process for producing the same, greatly contributes to various related fields such as foods and beverages, cosmetics, and pharmaceuticals as well as sugar manufacturing.

The invention claimed is:

1. A trehalose or maltose, which has the following characteristics:

(a) the trehalose or maltose is porous and crystalline;

(b) the trehalose or maltose has a specific surface area of 1 $m^2/g$ or higher when determined by gas adsorption isotherms using nitrogen; and (c) the trehalose or maltose has an intrusion volume of pores which is 0.1 ml/g or higher and the pores show one peak of pore size diameter of less than 5 μm, when pore size distribution is measured by the mercury filling method.

2. The porous crystalline trehalose or maltose of claim 1, wherein said crystalline trehalose is anhydrous and said crystalline maltose is anhydrous or hydrous.

3. The porous crystalline trehalose or maltose of claim 1, produced by a process comprising a step of stirring a hydrous crystalline trehalose or maltose in ethanol with heating at a temperature of 50° C. or higher.

* * * * *